US011333448B2

(12) United States Patent
Yang et al.

(10) Patent No.: US 11,333,448 B2
(45) Date of Patent: May 17, 2022

(54) PRINTED CIRCUIT HEAT EXCHANGER AND HEAT EXCHANGE DEVICE INCLUDING THE SAME

(71) Applicant: DOOSAN HEAVY INDUSTRIES & CONSTRUCTION CO., LTD., Changwon-si (KR)

(72) Inventors: Kihoon Yang, Yongin-si (KR); Sangeun Noh, Yongin-si (KR); Jeongkil Kim, Busan (KR); Jungshin Park, Yongin-si (KR)

( * ) Notice: Subject to any disclaimer, the term of this patent is extended or adjusted under 35 U.S.C. 154(b) by 56 days.

(21) Appl. No.: 16/529,814

(22) Filed: Aug. 2, 2019

(65) Prior Publication Data

US 2020/0088475 A1 Mar. 19, 2020

(30) Foreign Application Priority Data

Sep. 18, 2018 (KR) ..... 10-2018-0111821
Sep. 21, 2018 (KR) ..... 10-2018-0113954
Apr. 15, 2019 (KR) ..... 10-2019-0043702

(51) Int. Cl.
*F28F 3/04* (2006.01)
*F28F 13/12* (2006.01)
*F28F 3/08* (2006.01)

(52) U.S. Cl.
CPC ..... *F28F 3/048* (2013.01); *F28F 3/046* (2013.01); *F28F 3/08* (2013.01); *F28F 13/12* (2013.01); *F28F 2250/108* (2013.01)

(58) Field of Classification Search
CPC .... F28F 3/046; F28F 3/048; F28F 3/08; F28F 13/12
See application file for complete search history.

(56) References Cited

U.S. PATENT DOCUMENTS 4,470,455 A * 9/1984 Sacca ..... F28F 3/04 165/166
4,932,469 A * 6/1990 Beatenbough ..... F28F 3/046 165/170

(Continued)

FOREIGN PATENT DOCUMENTS

JP 2002-107074 A 4/2002
JP 2004508525 A 3/2004

(Continued)

OTHER PUBLICATIONS

A Korean Office Action dated Sep. 26, 2019 in connection with Korean Patent Application No. 10-2018-0113954.

*Primary Examiner* — Leonard R Leo
(74) *Attorney, Agent, or Firm* — Harvest IP Law, LLP

(57) ABSTRACT

A printed circuit heat exchanger is provided. The printed circuit heat exchanger may include: a first bonding plate configured to include two plates bonded to each other and zigzag-shaped flow channels formed adjacent to each other between the two plates such that some sections of each of the plurality of flow channels are formed to overlap with adjacent flow channels; and a second bonding plate configured to include two plates bonded to each other and zigzag-shaped flow channels formed adjacent to each other between the two plates such that some sections of each of the plurality of flow channels are formed to overlap with adjacent flow channels, wherein the first bonding plate and the second bonding plate are alternately stacked.

14 Claims, 23 Drawing Sheets

(56) References Cited

U.S. PATENT DOCUMENTS

| | | | | |
|---|---|---|---|---|
| 8,087,452 | B2 * | 1/2012 | Goldman | F28F 3/048 165/170 |
| 2006/0090887 | A1 | 5/2006 | Kato et al. | |
| 2015/0316326 | A1 | 11/2015 | Choi et al. | |

FOREIGN PATENT DOCUMENTS

| | | | |
|---|---|---|---|
| JP | 2005-226889 | A | 8/2005 |
| JP | 2010216754 | A | 9/2010 |
| JP | 2015-031420 | A | 2/2015 |
| JP | 2017223427 | A | 12/2017 |
| KR | 20-0158732 | Y1 | 10/1999 |
| KR | 10-0594185 | B1 | 6/2006 |
| KR | 10-0938802 | B1 | 1/2010 |
| KR | 10-0991113 | B1 | 11/2010 |
| KR | 10-1088611 | B1 | 11/2011 |
| KR | 10-1151758 | B1 | 6/2012 |
| KR | 10-1157711 | B1 | 6/2012 |
| KR | 10-2012-0075838 | A | 7/2012 |
| KR | 10-1202773 | B1 | 11/2012 |
| KR | 10-1218314 | B1 | 1/2013 |
| KR | 10-1233346 | B1 | 2/2013 |
| KR | 1020130056279 | A | 5/2013 |
| KR | 10-2013-0065173 | A | 6/2013 |
| KR | 10-1405394 | B1 | 6/2014 |
| KR | 10-2016-0139725 | A | 12/2016 |
| KR | 10-2017-0093513 | A | 8/2017 |
| KR | 10-2018-0037439 | A | 4/2018 |
| KR | 10-1892549 | B1 | 8/2018 |

* cited by examiner

PRINTED CIRCUIT HEAT EXCHANGER AND HEAT EXCHANGE DEVICE INCLUDING THE SAME

CROSS-REFERENCE TO RELATED APPLICATIONS

This application claims priority to Korean Patent Application Nos. 10-2018-0111821 filed on Sep. 18, 2018, 10-2018-0113954 filed on Sep. 21, 2018, and 10-2019-0043702 filed on Apr. 15, 2019, the disclosures of which are incorporated herein by reference in their entireties.

BACKGROUND

Field

Apparatuses and methods consistent with exemplary embodiments relate to a heat exchanger and a heat exchange device including the same.

Description of the Related Art

A heat exchanger is a device which exchanges heat between two types of fluid. Generally, in the heat exchanger, high-temperature fluid and low-temperature fluid exchange heat while respectively passing through tubes or plates, and the heat is transferred from the high-temperature fluid to the low-temperature fluid.

A printed circuit heat exchanger (PCHE) is a heat exchanger having fine flow channels. The PCHE is manufactured by stacking a plurality of metal plates and diffusion-bonding the metal plates under vacuum high-temperature conditions. Fine flow channels are formed in the metal plates by a chemical etching method. The PCHE is advantageous in that a heat transfer area may be increased by stacking a plurality of metal plates having fine flow channels. Therefore, it is possible to reduce a size and a weight of the heat exchanger.

However, because the related art PCHEs have a straight or zigzag flow channel pattern, there is a disadvantage in that a plurality of heat exchangers should be coupled in series to each other to increase a heat transfer length. Further, there is a disadvantage in that, if any one of the flow channels is clogged with dust, a by-product, or the like, the entire flow channels cannot be used.

Therefore, there is a need to design flow channels capable securing a sufficient heat transfer length without coupling a plurality of heat exchangers in series and capable of maintaining a performance of the entire flow channels even if any one of the flow channels is clogged.

Furthermore, in a case in which the related art PCHE is provided with a high-pressure header, a flow channel cannot be disposed around the high-pressure header to secure the structural integrity of the PCHE. Also, in a case in which the high-pressure header is connected to the PCHE by welding or formed by boring the PCHE, an additional process is needed, thus increasing the production cost.

Therefore, there is a need to design a PCHE capable of securing the structural integrity and efficiently utilizing a space in the heat exchanger.

In addition, because the PCHE is generally made of material such as stainless steel and a Ni-base alloy having excellent properties, the PCHE is advantageous in that it can be used in high-temperature, high-pressure, or cryogenic environment in which the typical heat exchangers cannot be used.

However, in the case in which the PCHE is used under cryogenic environment, high-temperature may be undesirably cooled by cryogenic fluid. For example, freezing may occur in an area in which a flow rate of fluid is relatively low. If a heat exchange device is suddenly stopped, remaining high-temperature fluid may be cooled by cryogenic fluid that remains in the flow channels and the headers. If fluid is cooled in the flow channels, a pump or other components may be damaged. When the heat exchange device is re-operated, an operational delay may occur.

Accordingly, there is a need to develop a PCHE capable of preventing fluid in the flow channels from freezing.

SUMMARY

Aspects of one or more exemplary embodiments provide a heat exchanger capable of maintaining an entire performance thereof even if some areas of flow channels are clogged with dust or foreign substances.

Aspects of one or more exemplary embodiments also provide a heat exchanger which has enhanced heat transfer efficiency by increasing a length of a heat transfer path.

Aspects of one or more exemplary embodiments further provide a printed circuit heat exchanger installed with a high-pressure header, thus simplifying a configuration thereof.

Aspects of one or more exemplary embodiments further provide a printed circuit heat exchanger capable of securing a structural integrity despite being provided with a high-pressure header, and capable of efficiently using an internal space of the heat exchanger.

Aspects of one or more exemplary embodiments further provide a heat exchanger capable of preventing flow channels from freezing using a simple configuration.

Additional aspects will be set forth in part in the following description and, in part, become apparent from the description, or may be learned by practice of the exemplary embodiments.

According to an aspect of an exemplary embodiment, there is provided a printed circuit heat exchanger including: a first bonding configured to include two plates bonded to each other and a plurality of zigzag-shaped flow channels formed adjacent to each other between the two plates such that some sections of each of the plurality of flow channels are formed to overlap with adjacent flow channels; and a second bonding plate configured to include two plates bonded to each other and a plurality of zigzag-shaped flow channels formed adjacent to each other between the two plates such that some sections of each of the plurality of flow channels are formed to overlap with adjacent flow channels, wherein the first bonding plates and the second bonding plates may be alternately stacked.

The first bonding plate may include an upper plate configured to include a plurality of straight flow channels extending to one side oblique to a longitudinal direction, and a lower plate configured to include a plurality of straight flow channels extending to the other side oblique to the longitudinal direction, and may be formed by bonding the upper plate and the lower plate to each other such that the flow channels face each other.

The second bonding plate may include an upper plate configured to include a plurality of straight flow channels extending to one side oblique to a longitudinal direction, and a lower plate configured to include a plurality of straight flow channels extending to the other side oblique to the longitudinal direction, and may be formed by bonding the upper plate and the lower plate to each other such that the flow channels face each other.

The plurality of straight flow channels of the upper plate and the plurality of straight flow channels of the lower plate may overlap with each other at intersections therebetween.

Each of the first bonding plate and the second bonding plate may have a rectangular shape.

The flow channels that are formed in an end area of the first bonding plate each have a straight shape parallel to a long side of the first bonding plate.

The flow channels that are formed in an end area of the second bonding plate each have a straight shape parallel to a short side of the second bonding plate.

Overlapping parts between the flow channels of the upper plate and the flow channels of the lower plate each have a straight shape extending a predetermined length parallel to long sides of the upper plate and the lower plate.

According to an aspect of another exemplary embodiment, there is provided a printed circuit heat exchanger including: a body part formed by stacking a plurality of first plates and a plurality of second plates, each of the plurality of first and second plates having flow channels, a first high-pressure header configured to flow fluid through the first plate and include an inlet formed in an upper surface of the body part, a second high-pressure header configured to retrieve the fluid from the first plate and include an outlet formed in the upper surface of the body part, a first low-pressure header configured to flow fluid through the second plate and include an inlet formed in an upper surface of the body part, and a second low-pressure header configured to retrieve the fluid from the second plate and include an outlet formed in the upper surface of the body part.

The first plate may include a first bonding plate including two plates bonded to each other and a plurality of zigzag-shaped flow channels formed adjacent to each other between the two plates such that some sections of each of the plurality of flow channels are formed to overlap with adjacent flow channels. The second plate may include a second bonding plate including two plates bonded to each other and a plurality of zigzag-shaped flow channels formed adjacent to each other between the two plates such that some sections of each of the plurality of flow channels are formed to overlap with adjacent flow channels.

Each of the first and second high-pressure headers may have a cylindrical shape.

A distance between the first high-pressure header and a first end of the body part and a distance between the first high-pressure header and a second end of the body part may be greater than a diameter of the first high-pressure header.

An opening area of the first and second high-pressure headers may be less than an opening area of the first and second low-pressure headers.

The first and second high-pressure headers may be formed on a diagonal line in the upper surface of the body part, and the first and second low-pressure headers may be formed on an opposite-side diagonal line in the upper surface of the body part.

The printed circuit heat exchanger may further include a first L-shaped cavity. The first L-shaped cavity may be disposed in a perimeter of the body part and have a space extending a predetermined depth downward. The first L-shaped cavity may be configured to receive fluid from the first low-pressure header and retrieve the fluid into the second low-pressure header.

The printed circuit heat exchanger may further include a second L-shaped cavity formed in the body part at a position symmetrical to the first L-shaped cavity based on a center point of the body part.

A volume of the first L-shaped cavity may be greater than the volume of the second L-shaped cavity.

In the plurality of flow channels of the second plate, a flow channel disposed adjacent to the first high-pressure header may be greater in width than a flow channel disposed in an inner side.

In the plurality of flow channels of the second plate, an arrangement interval between flow channels disposed adjacent to the first high-pressure header may be less than an arrangement interval between flow channels disposed in an inner side.

A depth of the first L-shaped cavity may be ½ or less of a height of the body part.

BRIEF DESCRIPTION OF THE DRAWINGS

The above and other aspects will be more apparent from the following description of the exemplary embodiments with reference to the accompanying drawings, in which.

DETAILED DESCRIPTION

Figure 1:
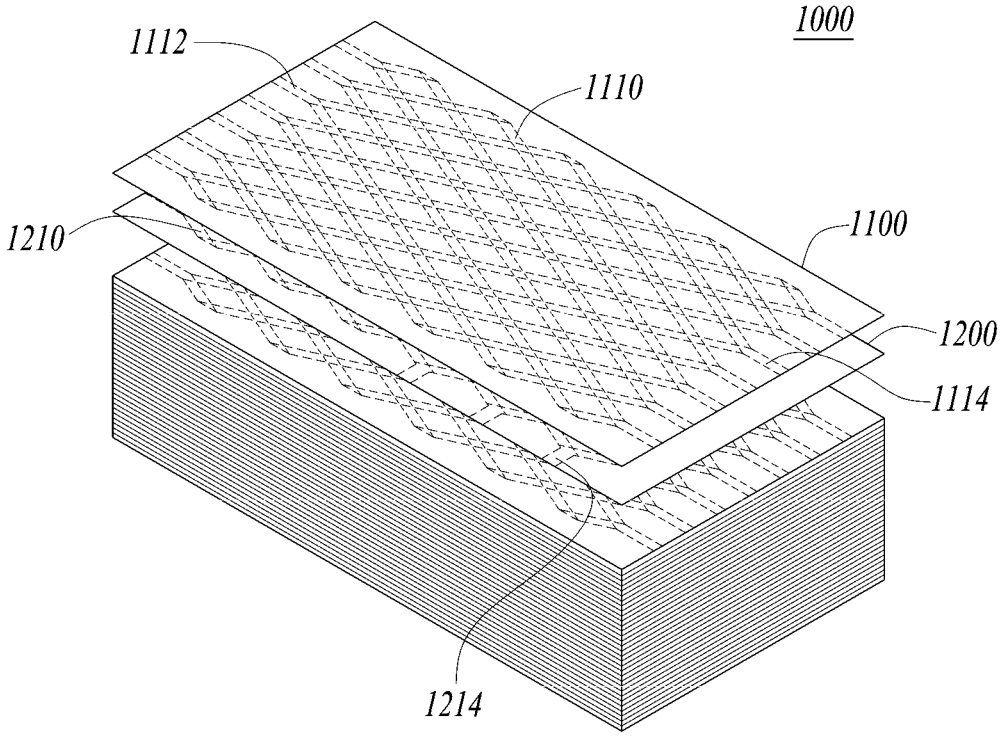
FIG. 1 is a diagram illustrating a printed circuit heat exchanger in accordance with an exemplary embodiment.

Various modifications may be made to the embodiments of the disclosure, and there may be various types of embodiments. Thus, specific embodiments will be illustrated in the accompanying drawings and will be described in detail in the description. However, it should be noted that the various embodiments are not for limiting the scope of the disclosure to a specific embodiment, but they should be interpreted to include all modifications, equivalents or alternatives of the embodiments included in the ideas and the technical scopes disclosed herein. Meanwhile, in case it is determined that in describing the embodiments, detailed explanation of related known technologies may unnecessarily confuse the gist of the disclosure, the detailed explanation will be omitted.

The terminology used herein is for the purpose of describing particular embodiments only and is not intended to limit the scope of the disclosure. As used herein, the singular forms "a", "an", and "the" are intended to include the plural forms as well, unless the context clearly indicates otherwise. Further, the terms "comprise", "include", or "have/has" should be construed as designating that there are such features, integers, steps, operations, elements, components, and/or combinations thereof in the specification, not to exclude the presence or possibility of adding one or more of other features, integers, steps, operations, elements, components, and/or combinations thereof.

Further, terms such as "first," "second," and so on may be used to describe a variety of elements, but the elements should not be limited by these terms. The terms are used simply to distinguish one element from other elements. The use of such ordinal numbers should not be construed as limiting the meaning of the term. For example, the components associated with such an ordinal number should not be limited in the order of use, placement order, or the like. If necessary, each ordinal number may be used interchangeably.

Hereinafter, one or more exemplary embodiments will be described in detail with reference to the accompanying drawings. In order to clearly illustrate the disclosure in the drawings, some of the elements that are not essential to the complete understanding of the disclosure may be omitted, and like reference numerals refer to like elements throughout the specification.

Figure 2:
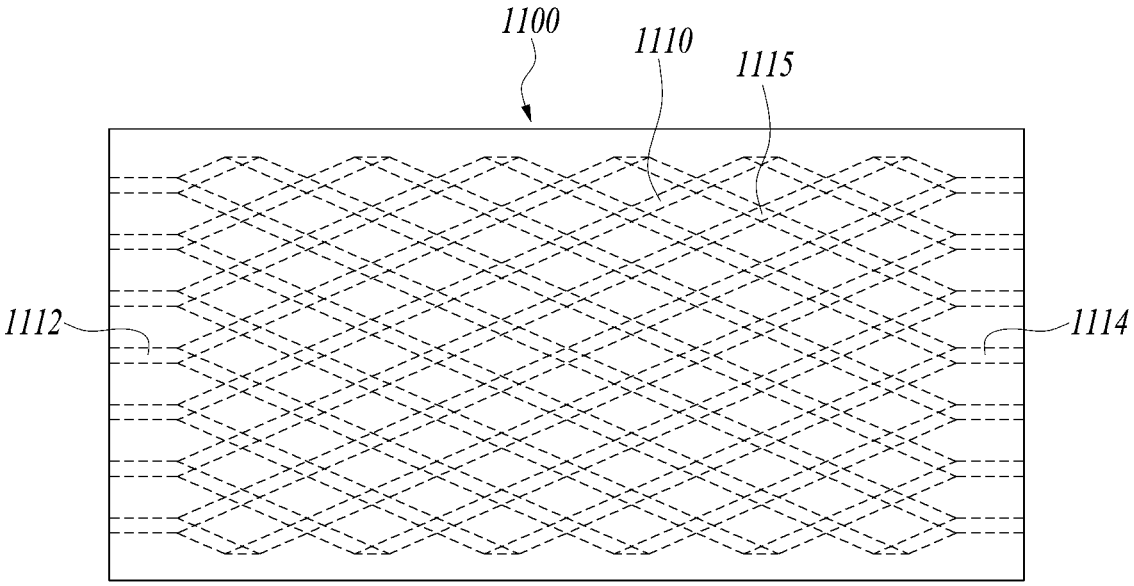
FIG. 2 is a diagram illustrating a first bonding plate of the printed circuit heat exchanger in accordance with an exemplary embodiment.
Figure 3A:
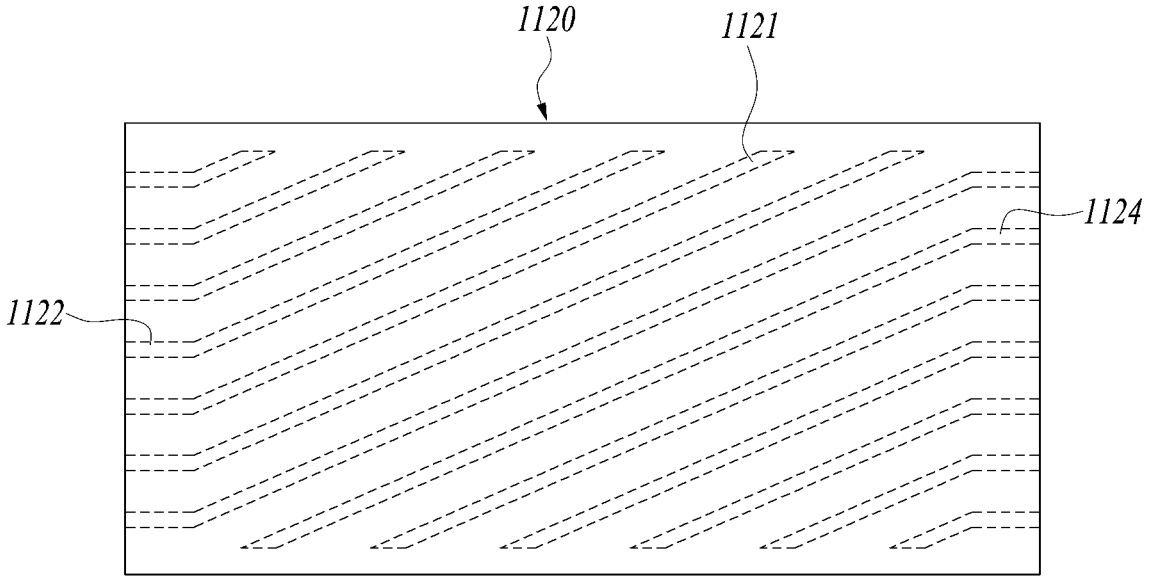
FIGS. 3A and 3B are diagrams illustrating an upper plate and a lower plate that form the first bonding plate of the printed circuit heat exchanger in accordance with an exemplary embodiment.
Figure 3B:
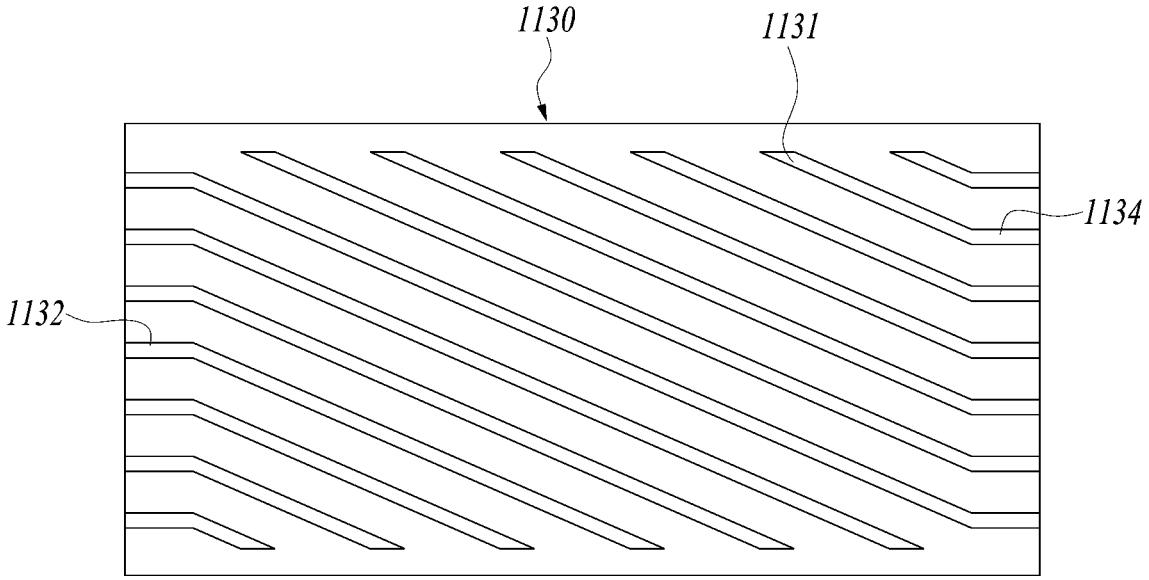
Figure 4:
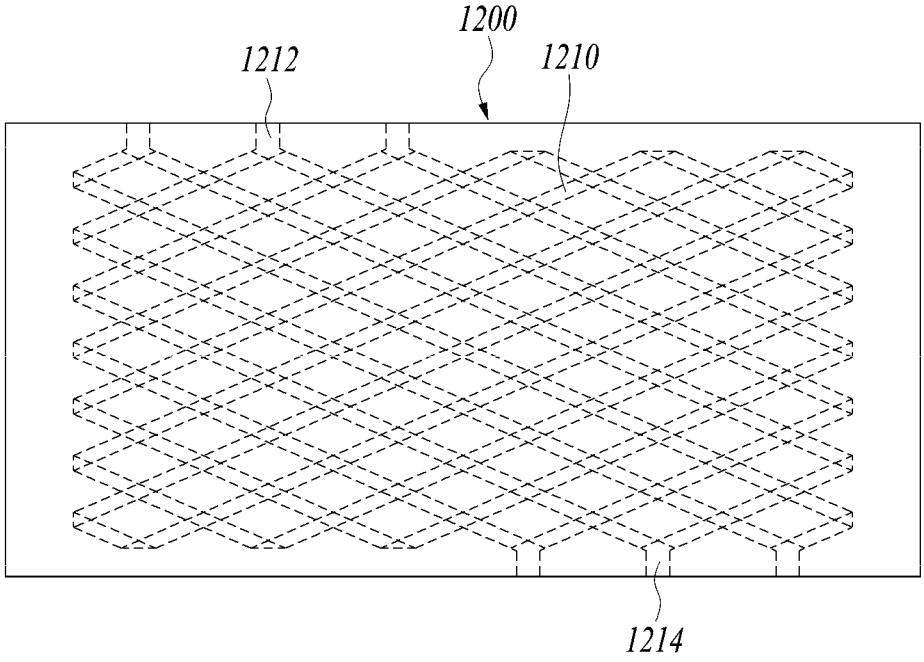
FIG. 4 is a diagram illustrating a second bonding plate of the printed circuit heat exchanger in accordance with an exemplary embodiment.

FIG. 1 is a diagram illustrating a printed circuit heat exchanger in accordance with an exemplary embodiment, FIG. 2 is a diagram illustrating a first bonding plate of the printed circuit heat exchanger in accordance with an exemplary embodiment, FIGS. 3A and 3B are diagrams respectively illustrating an upper plate and a lower plate that form the first bonding plate of the printed circuit heat exchanger in accordance with an exemplary embodiment, and FIG. 4 is a diagram illustrating a second bonding plate of the printed circuit heat exchanger in accordance with an exemplary embodiment.

Referring to FIG. 1, the printed circuit heat exchanger 1000 includes first bonding plates 1100 and second bonding plates 1200.

The first bonding plates 1100 and the second bonding plates 1200 may be alternately stacked. FIG. 1 illustrates a case in which the first bonding plates 1100 and the second bonding plates 1200 are alternately stacked, but it is understood that this is only an example and other exemplary embodiments are not limited thereto. The first bonding plates 1100 and the second bonding plates 1200 may be stacked at a ratio of 1:2 or 2:1.

Different types of fluid may flow through flow channels 1110 and 1210 which are respectively formed in each first bonding plate 1100 and each second bonding plate 1200. High-temperature fluid may flow on the first bonding plate 1100, and low-temperature fluid may flow on the second bonding plate 1200. For example, the fluid that flows on the first bonding plate 1100 may be ethylene glycol (EG) or water, and the fluid that flows on the second bonding plate 1200 may be cryogenic fluid such as liquefied natural gas (LNG).

The first and second bonding plates 1100 and 1200 may be made of heat resistant material such as stainless steel and a Ni-base alloy. The flow channels 1110 and 1210 are formed in the first and second bonding plates 1100 and 1200. Fine flow channels may be formed, by etching, in plates made of material such as stainless steel, and a bonding plate may be formed by bonding two plates provided with the flow channels to each other such that the two plates face each other.

Referring to FIG. 2, the flow channel 1110 is formed in the first bonding plate 1100. The first bonding plate 1100 is formed by bonding two plates respectively having flow channels in surfaces thereof facing each other. In other words, the first bonding plate 1100 includes an upper plate 1120 and a lower plate 1130 between which a plurality of flow channels 1110 each having a zigzag shape are disposed adjacent each other and overlap with each other in some sections. The plurality of flow channels 1110 each having the zigzag shape may form a rhombus flow channel in a plan view by overlapping adjacent flow channels 1110 with each other at intersections therebetween or vertices thereof.

As illustrated in FIG. 3A, a plurality of straight flow channels 1121 are formed in a lower surface of the upper plate 1120 in a direction oblique to a longitudinal direction of the upper plate 1120. Inlets 1122 and outlets 1124 which are coupled to the plurality of straight flow channels 1121 are formed in longitudinal end areas of the upper plate 1120. In lateral end areas of the upper plate 1120, ends of the plurality of flow channels 1121 are disposed at positions spaced apart inward from lateral ends of the upper plate 1120 by a predetermined distance.

Further, as illustrated in FIG. 3B, a plurality of straight flow channels 1131 are formed in an upper surface of the lower plate 1130 in a direction oblique to a longitudinal direction of the lower plate 1130. Inlets 1132 and outlets 1134 which are coupled to the plurality of straight flow channels 1131 are formed in longitudinal end areas of the lower plate 1130. In lateral end areas of the lower plate 1130, ends of the plurality of flow channels 1131 are disposed at positions spaced apart inward from lateral ends of the lower plate 1130 by a predetermined distance.

The first bonding plate 1100 is formed by bonding the lower surface of the upper plate 1120 and the upper surface of the lower plate 1130 such that the flow channels 1121 and 1131 face each other. The upper plate 1120 and the lower plate 1130 may be bonded, under high pressure applied to upper and lower layers of plates, to each other on areas except the flow channels 1121 and 1131.

As illustrated in FIG. 2, the flow channels 1121 and 1131 intersect with each other at least one portion, thus forming an overlapping section 1115 of the flow channel 1110. Each of the flow channels 1121 and 1131 is formed by etching, and the cross-section thereof may have a semi-circular or semi-elliptical shape. The flow channel 1110 may be formed in a shape having a plurality of rhombi on a plan view. The flow channel 1110 may have a circular or elliptical cross-sectional shape in inlets 1112, outlets 1114, and the overlapping sections 1115.

Referring to FIG. 4, the second bonding plate 1200 may include an upper plate having in a lower surface thereof a plurality of straight flow channels extending to one side oblique to a longitudinal direction, and a lower plate having in an upper surface thereof a plurality of straight flow channels extending to the other side oblique to the longitudinal direction, and may be formed by bonding the upper plate and the lower plate to each other such that the flow channels face each other.

Also, in the second bonding plate 1200 formed by bonding the two plates each having a plurality of oblique flow channels, the plurality of flow channels 1210 each having a zigzag shape may form a rhombus flow channel by overlapping adjacent flow channels 1210 with each other at vertices thereof. In the second bonding plate 1200, a difference from the first bonding plate 1100 is that inlets 1212 and outlet 1214 are formed in lateral opposite ends of the second bonding plate 1200.

A plurality of inlets 1212 may extend in the lateral direction from vertices formed on first side ends of the flow channels 1210. A plurality of outlets 1214 may extend in the lateral direction from vertices formed on second side ends of the flow channels 1210. The inlets 1212 and the outlets 1214 may be formed in all of the opposite side ends of the flow channels 1210, or may be formed in some of the opposite side ends of the flow channels 1210. FIG. 4 illustrates the case in which three inlets 1212 and three outlets 1214 are formed.

Each of the first bonding plate 1100 and the second bonding plate 1200 may have a rectangular shape. In this case, inlets 1112 and outlets 1114 that are flow channels formed in the end areas of the first bonding plate 1100 each may have a straight shape parallel to long sides of the first bonding plate 1100. Furthermore, inlets 1212 and outlets 1214 that are flow channels formed in the end areas of the second bonding plate 1200 each may have a straight shape parallel to short sides of the second bonding plate 1200.

The flow channel 1210 may have a circular or elliptical cross-sectional shape in the inlets 1112, the outlets 1114, and the overlapping sections 1115, and have a semi-circular or semi-elliptical cross-sectional shape in the other portions thereof.

In the printed circuit heat exchanger 1000 in accordance with one or more exemplary embodiments, the flow channels 1110 and 1210 formed in each of the first and second bonding plates 1100 and 1200 have bifurcations at positions overlapping with adjacent flow channels so that the flow of fluid drawn into each flow channel may be divided into two directions at each bifurcation. Therefore, compared to the case in which the flow channels include a plurality of straight lines or a plurality of zigzag lines, even if some flow channels are clogged, the flow performance of the entire flow channels may be prevented from being deteriorated. In other words, in the flow channels formed in the printed circuit heat exchanger 1000, even if some portions thereof are clogged, fluid may move through flow channels coupled to other bifurcations. Therefore, unlike the straight or zigzag flow channels, the entire flow channels may be prevented from being clogged.

Here, a plurality of first bonding plates 1100 and a plurality of second bonding plates 1200 are stacked and diffusion-bonded. To secure a durability of the heat exchanger, the flow channels 1110 and 1210 are respectively disposed at positions spaced apart from the outer edges of the first bonding plate 1100 and the second bonding plate 1200 by a predetermined distance. The inlets 1112 and 1212 and the outlets 1114 and 1214 are formed in the lateral end areas of the first bonding plate 1100 and the second bonding plate 1200 so that fluid is drawn into or discharged out of the flow channels 1110 and 1210 through the inlets 1112 and 1212 and the outlets 1114 and 1214. The inlets 1112 and 1212 and the outlets 1114 and 1214 are coupled to a header so that fluid may be supplied to the flow channels 1110 and 1210 or retrieved from the flow channels 1110 and 1210. A plurality of first bonding plates 1100 and a plurality of second bonding plates 1200 are alternately stacked, and the plurality of bonding plates 1100 and 1200 may be bonded at once to each other under high pressure on areas except the flow channels 1110 and 1210.

Figure 5:
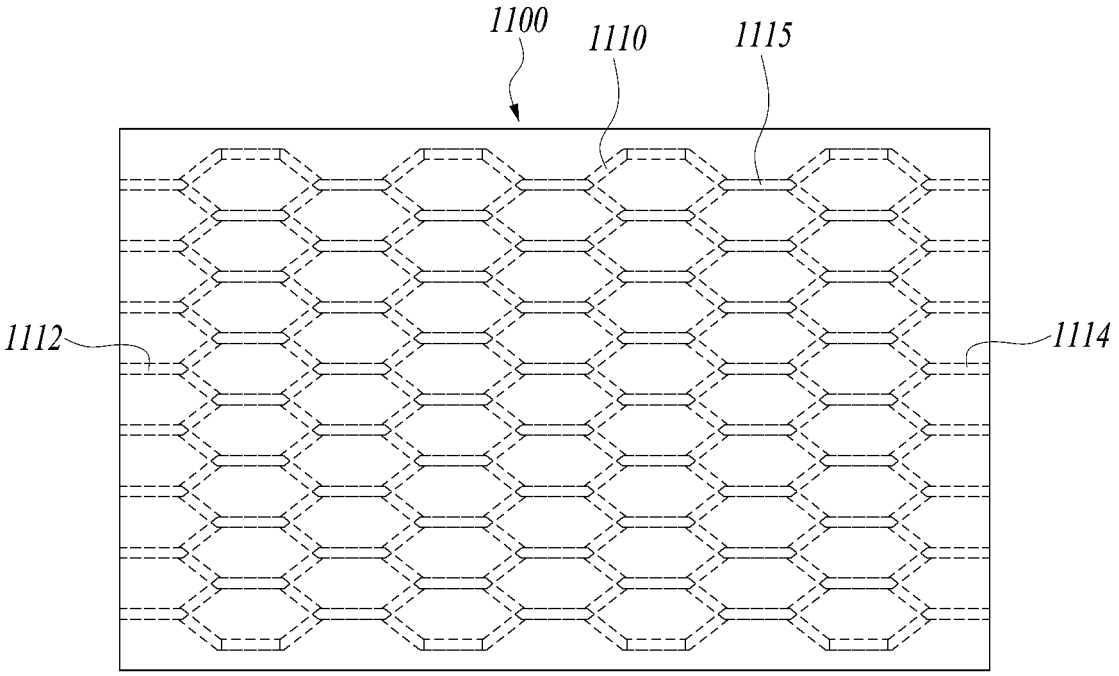
FIG. 5 is a diagram illustrating a first bonding plate of the printed circuit heat exchanger in accordance with an exemplary embodiment.
Figure 6A:
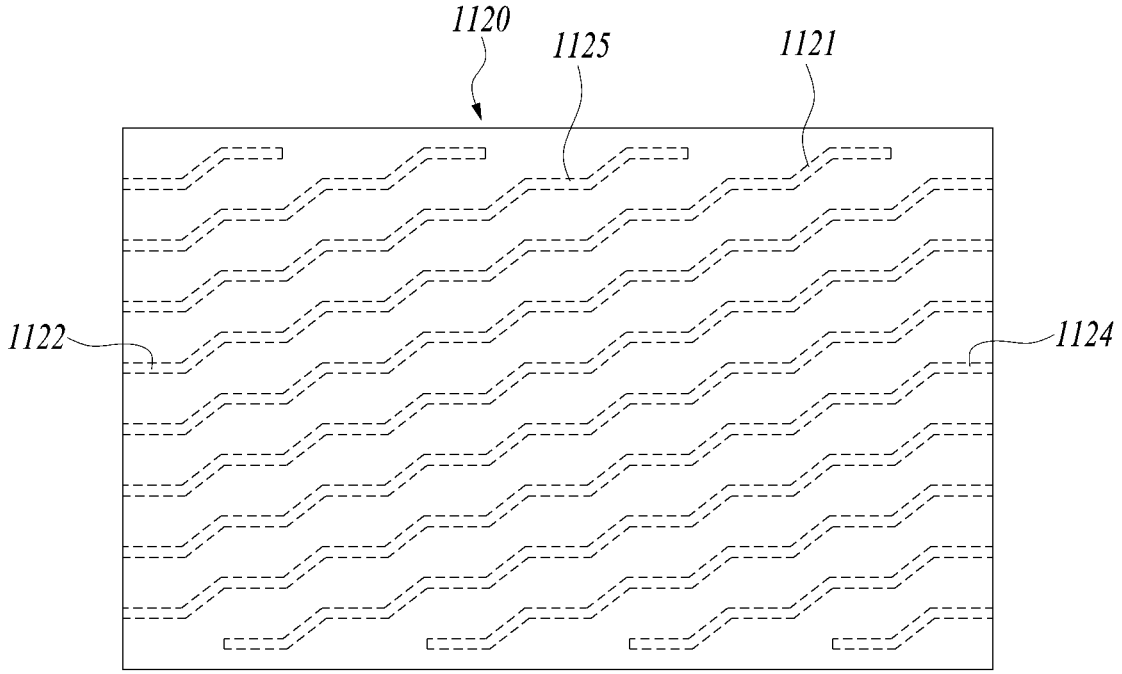
FIGS. 6A and 6B are diagrams illustrating an upper plate and a lower plate that form the first bonding plate of the printed circuit heat exchanger in accordance with an exemplary embodiment.
Figure 6B:
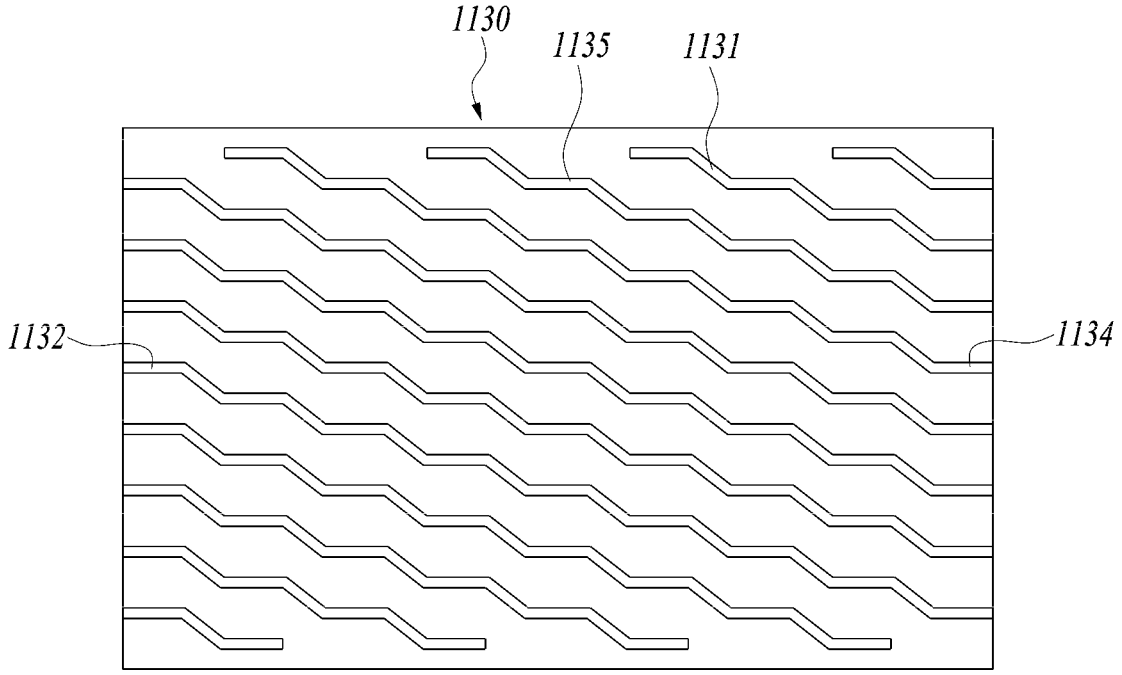

FIG. 5 is a diagram illustrating a first bonding plate of the printed circuit heat exchanger in accordance with an exemplary embodiment, and FIGS. 6A and 6B are diagrams illustrating an upper plate and a lower plate that form the first bonding plate of the printed circuit heat exchanger in accordance with an exemplary embodiment.

Referring to FIGS. 5, 6A, and 6B, overlapping portions between flow channels 1121 of an upper plate 1120 of the first bonding plate 1100 and flow channels 1131 of a lower plate 1130 of the first bonding plate 1100 each may have a straight shape having a predetermined length and extending parallel to the long sides of the first bonding plate 1100. In other words, overlapping sections 1125 and 1135 of the flow channels 1121 and 1131 of the two plates 1120 and 1130 each extend a predetermined length in the longitudinal direction of the plates 1120 and 1130. The flow channels 1121 and 1131 of the two plates 1120 and 1130 are combined with each other to form a flow channel 1110 having a shape including a plurality of hexagons or a honeycomb shape.

The first bonding plate 1100 includes a plurality of inlets 1112 and a plurality of outlets 1114 which are formed in opposite short sides of a rectangle in a direction parallel to long sides of the rectangle.

As illustrated in FIG. 6A, the plurality of flow channels 1121 are formed in a lower surface of the upper plate 1120. In each of the flow channels 1121, oblique flow channel sections 1121 and longitudinal overlapping sections 1125 are formed from a longitudinal inlet 1122 once to several times repeatedly, and an outlet 1124 is coupled to an end of the flow channel 1121.

Also, as illustrated in FIG. 6B, a plurality of flow channels 1131 are formed in an upper surface of the lower plate 1130.

In each of the flow channels 1131, oblique flow channel sections 1131 and longitudinal overlapping sections 1135 are formed from a longitudinal inlet 1132 once to several times repeatedly, and an outlet 1134 is coupled to an end of the flow channel 1131.

In the respective flow channels 1121 and 1131 of the upper plate 1120 and the lower plate 1130, the inlets 1122 and 1132, the overlapping sections 1125 and 1135, and the outlets 1124 and 1134 overlap with each other to form a circular or elliptical cross-sectional shape, and are formed parallel to the longitudinal direction parallel to long sides of the plate.

As such, in the case of the heat exchanger having a honeycombed flow channel, longitudinal straight sections of the overlapping sections are increased, so that pressure drop is reduced. If the pressure drop is increased, the heat exchange performance is reduced, and it is difficult to maintain the intended performance of the heat exchanger. Given this, in the exemplary embodiment, the heat exchanger may be designed such that the pressure drop is reduced depending on required performance of the heat exchanger.

Figure 7:
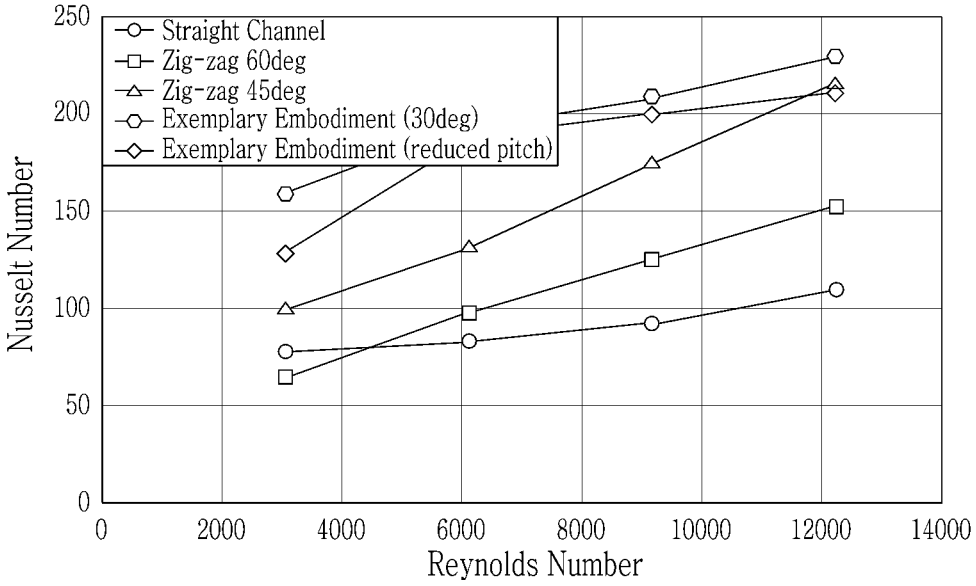
FIG. 7 is a diagram for describing heat transfer performance of the heat exchanger in accordance with an exemplary embodiment.
Figure 8:
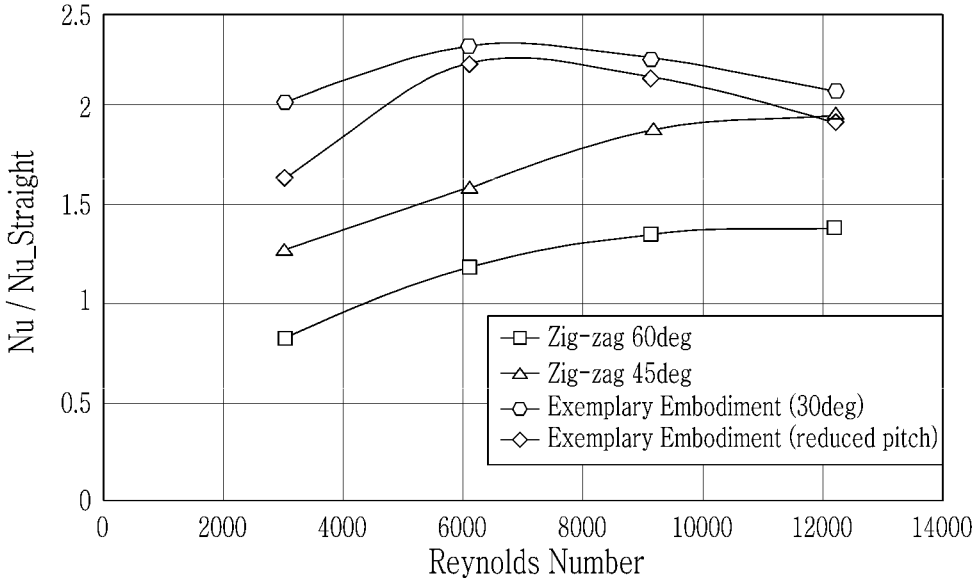
FIG. 8 is a diagram for comparative description of the heat transfer performance of the heat exchanger in accordance with an exemplary embodiment.
Figure 9:
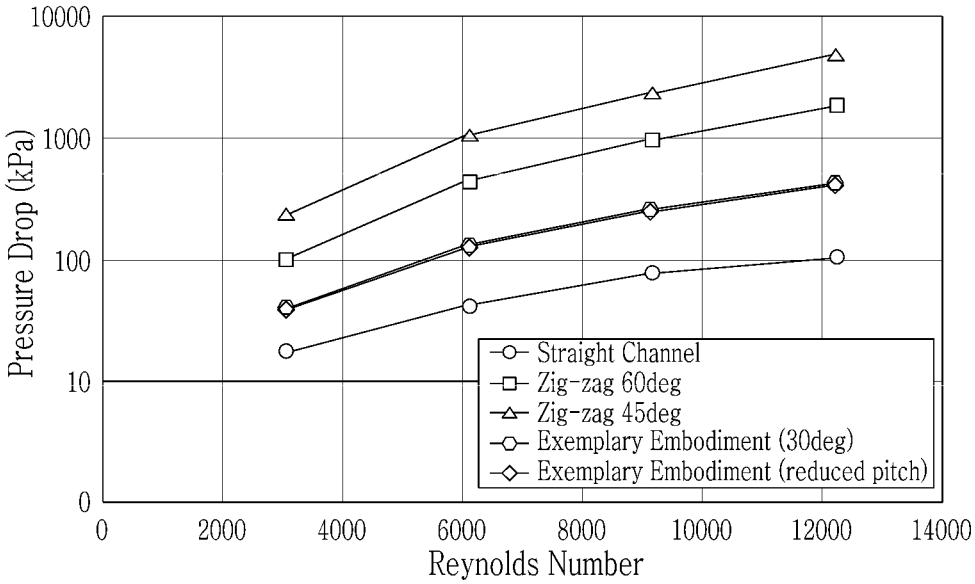
FIG. 9 is a diagram for describing pressure drop performance of the heat exchanger in accordance with an exemplary embodiment.
Figure 10:
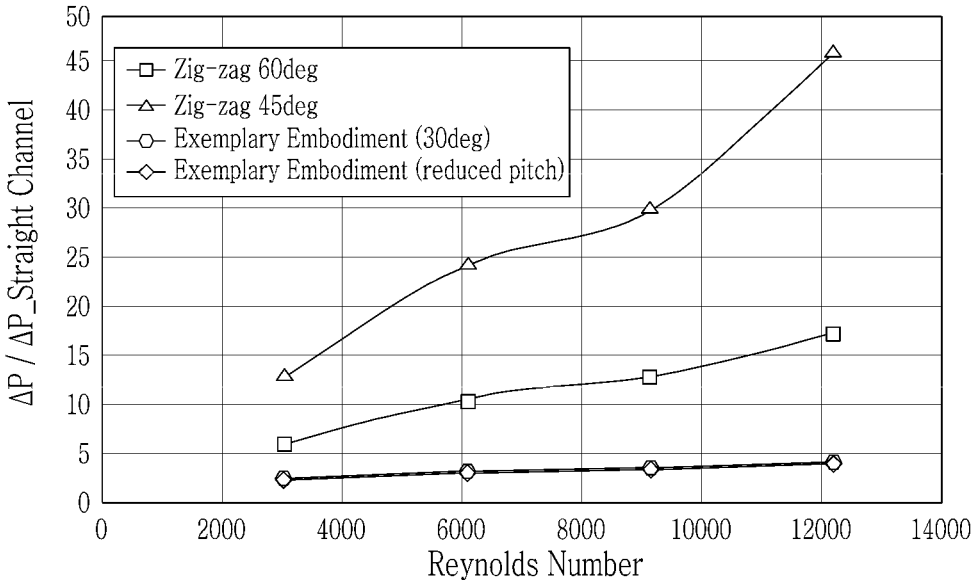
FIG. 10 is a diagram for comparative description of the pressure drop performance of the heat exchanger in accordance with an exemplary embodiment.

FIG. 7 is a diagram for describing heat transfer performance of the heat exchanger in accordance with an exemplary embodiment, FIG. 8 is a diagram for comparative description of the heat transfer performance of the heat exchanger in accordance with an exemplary embodiment, FIG. 9 is a diagram for describing pressure drop performance of the heat exchanger in accordance with an exemplary embodiment, and FIG. 10 is a diagram for comparative description of the pressure drop performance of the heat exchanger in accordance with an exemplary embodiment. FIGS. 8 and 10 illustrate relative values for straight flow channels.

In the heat exchanger 1000 in accordance with the exemplary embodiment, a three-dimensional flow channel having a rhombus shape is formed in the plate so that a diffusion bonding surface having a comparatively large area can be formed, whereby a structural stability of the heat exchanger 1000 may be enhanced. Furthermore, fluid that flows through the flow channels is mixed in the overlapping sections and divided into upper and lower parts after colliding with edges of the overlapping sections. Therefore, the heat transfer performance may be enhanced.

Referring to FIGS. 7 and 8, when comparing in heat transfer performance a straight flow channel, a zigzag flow channel, and the three-dimensional rhombus flow channel according to the exemplary embodiment, it may be checked that the flow channel according to the exemplary embodiment is most excellent.

In more detail, in the case of the zigzag flow channel, it may be checked that a flow channel formed at an angle of 45° relative to the lateral direction is more excellent in heat transfer performance than a flow channel formed at an angle of 60°. Furthermore, in the case of a flow channel pattern according to the exemplary embodiment, it may be checked that a flow channel formed at an angle of 30° relative to the lateral direction is more excellent in heat transfer performance than a flow channel having a reduced pitch, i.e., a flow channel having a rhombus shape with an increased angle relative to the lateral direction.

Referring to FIGS. 9 and 10, when comparing in pressure drop a straight flow channel, a zigzag flow channel, and the three-dimensional rhombus flow channel according to the exemplary embodiment, it may be checked that the flow channel according to the exemplary embodiment induces the lowest pressure drop after the straight flow channel.

In other words, it may be checked that, if the flow channel of the PCHE has a three-dimensional structure having a rhombus shape, the PCHE may have high heat transfer efficiency and low-pressure-drop performance so that the heat exchange efficiency thereof may be enhanced.

Figure 11:
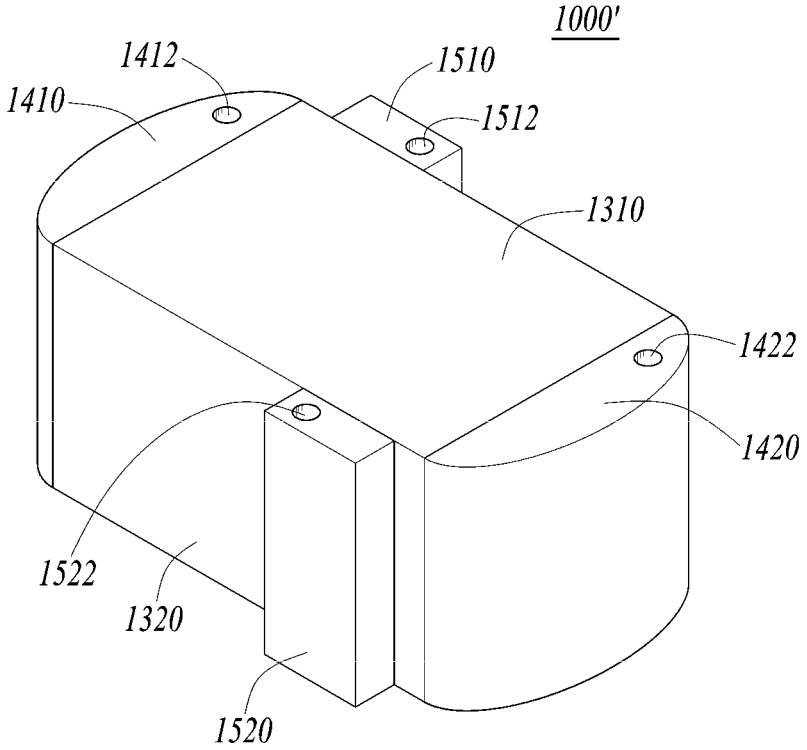
FIG. 11 is a diagram illustrating a heat exchange device in accordance with an exemplary embodiment.

FIG. 11 is a diagram illustrating a heat exchange device in accordance with an exemplary embodiment.

Referring to FIG. 11, the heat exchange device 1000' may include a printed circuit heat exchanger 1000, an upper cover 1310, a lower cover 1320, a pair of first headers 1410 and 1420, and a pair of second headers 1510 and 1520.

The printed circuit heat exchanger 1000 is formed by alternately stacking first and second plates 1100 and 1200. Flow channels are formed in upper surfaces of the first and second plates 1100 and 1200. For example, 40 to 50 plates, maximally, 500 plates, may be stacked and diffusion-bonded. The upper cover 1310 is mounted to an upper part of the heat exchanger 1000 formed by stacking and bonding the plates. The lower cover 1320 is mounted to a lower part of the heat exchanger 1000. The upper cover 1310 and the lower cover 1320 function to stably fix the plurality of plates 1100 and 1200 bonded to each other. The upper cover 1310 and the lower cover 1320 may be made of the same material, e.g., stainless steel, as that of the plates of the heat exchanger 1000.

The pair of first headers 1410 and 1420 may be mounted to lateral ends of the heat exchanger 1000 and may circulate high-temperature fluid in the heat exchanger 1000. The first header 1410 may supply high-temperature fluid into the first bonding plates 1100 of the heat exchanger 1000, and the first header 1420 may retrieve the fluid from the first bonding plates 1100. A fluid supply hole 1412 is formed in an upper surface of the first header 1410 so that the fluid may be supplied into the first header 1410 through the fluid supply hole 1412. A fluid retrieve hole 1422 is formed in an upper surface of the first header 1420 so that the fluid may be retrieved from the first header 1420 through the fluid retrieve hole 1422.

The pair of second headers 1510 and 1520 may be mounted to longitudinal ends of the heat exchanger 1000 and may circulate low-temperature fluid in the heat exchanger 1000. The second header 1510 may supply low-temperature fluid into the second bonding plates 1200 of the heat exchanger 1000, and the second header 1520 may retrieve the fluid from the second bonding plates 1200. A fluid supply hole 1512 is formed in an upper surface of the second header 1510 so that the fluid may be supplied into the second header 1510 through the fluid supply hole 1512. A fluid retrieve hole 1522 is formed in an upper surface of the second header 1520 so that the fluid may be retrieved from the second header 1520 through the fluid retrieve hole 1522.

Figure 12:
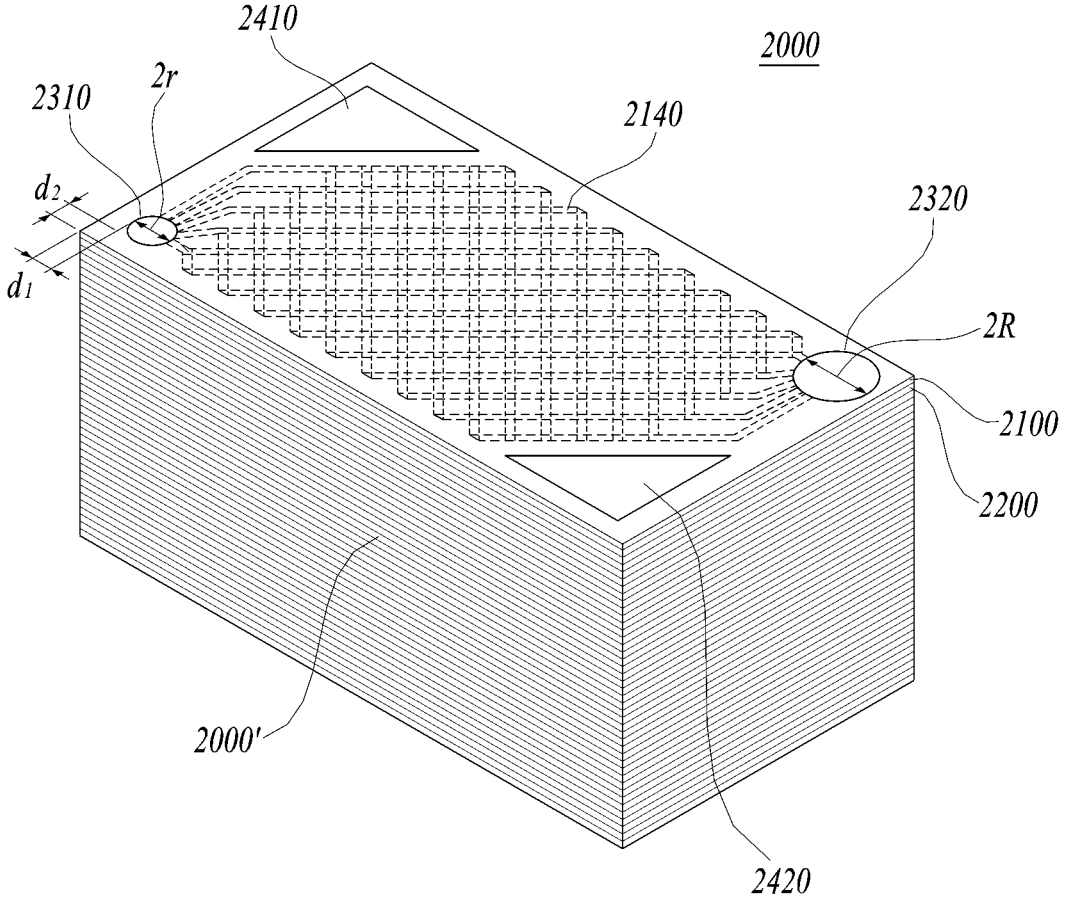
FIG. 12 is a diagram illustrating a printed circuit heat exchanger in accordance with an exemplary embodiment.

FIG. 12 is a diagram illustrating a printed circuit heat exchanger in accordance with an exemplary embodiment.

Referring to FIG. 12, a printed circuit heat exchanger 2000 may include a body part 2000', a first high-pressure header 2310, a second high-pressure header 2320, a first low-pressure header 2410, and a second low-pressure header 2420. The body part 2000' is formed by stacking first and second plates 2100 and 2200.

The first plate 2100 and the second plate 2200 may be formed of a first bonding plate and a second bonding plate each of which is formed by bonding a pair of upper and lower plates to each other.

The first plates 2100 and the second plates 2200 may be alternately stacked. FIG. 12 illustrates a case in which the first plates 2100 and the second plates 2200 are alternately stacked, but it is understood that this is only an example and other exemplary embodiments are not limited thereto. The first plates 2100 and the second plates 2200 may be stacked at a ratio of 1:2 or 2:1.

Different types of fluid respectively flow through flow channels 2140 and 2240 formed in the first and second plates 2100 and 2200. High-pressure fluid may flow on the first plate 2100, and low-pressure fluid may flow on the second plate 2200. The first and second plates 2100 and 2200 may be made of heat resistant material such as stainless steel and a Ni-base alloy.

In an exemplary embodiment, a plurality of first plates 2100 and a plurality of second plates 2200 are stacked and diffusion-bonded.

The first high-pressure header 2310 forms a cylindrical space extending from an upper surface of the body part 2000' in a thickness direction of the body part 2000'. An inlet hole through which high-pressure fluid is drawn into the first high-pressure header 2310 is formed in the upper surface of the body part 2000'. High-pressure fluid is drawn into the first high-pressure header 2310 so that the fluid can circulate through the first plates 2100. The first high-pressure header 2310 is formed at a position spaced apart from an edge of the upper surface of the body part 2000' by a predetermined distance.

High-pressure fluid drawn into the first high-pressure header 2310 applies high pressure to an inner wall of the first high-pressure header 2310. To make it possible for the first high-pressure header 2310 to resist the pressure applied to the inner wall thereof, a predetermined thickness of the inner wall that forms the first high-pressure header 2310, in other words, a bonding surface having a predetermined area around the first high-pressure header 2310, should be secured. However, there is a problem in that a surface area capable of arranging flow channels on the first plate 2100 is reduced to secure the bonding surface around the first high-pressure header 2310.

To overcome the problem, in the exemplary embodiment, a diameter 2*r* of the first high-pressure header 2310 is minimized, and the first high-pressure header 2310 is disposed at one side of the first plate 2100. Furthermore, to secure the durability, spacing distances d1 and d2 by which the first high-pressure header 2310 is spaced apart from corresponding edges of the body part 2000' are greater than the diameter 2*r* of the first high-pressure header 2310. Due to a sufficient spacing distance between the first high-pressure header 2310 and the edges of the body part 2000', a sufficient durability of the body part 2000' that resist the flow of high-pressure fluid may be secured.

The second high-pressure header 2320 is disposed at a position which is diagonally symmetrical to the first high-pressure header 2310. The second high-pressure header 2320 forms a cylindrical space extending from the upper surface of the body part 2000' in a thickness direction of the body part 2000'. The second high-pressure header 2320 may retrieve the fluid that has circulated through the first plate 2100. An outlet hole through which high-pressure fluid is retrieved from the second high-pressure header 2320 is formed in the upper surface of the body part 2000'. The second high-pressure header 2320 is formed at a position spaced apart from an edge of the upper surface of the body part 2000' by a predetermined distance. The second high-pressure header 2320 may have a minimized diameter 2R and be disposed at one side. Spacing distances d1 and d2 by which the second high-pressure header 2320 is spaced apart from corresponding edges of the body part 2000' are greater than the diameter 2R of the second high-pressure header 2320.

The diameter 2R of the second high-pressure header 2320 may be equal to the diameter 2*r* of the first high-pressure header 2310. In the exemplary embodiment, the diameter 2R of the second high-pressure header 2320 may be greater than the diameter 2*r* of the first high-pressure header 2310.

Although in this exemplary embodiment the second high-pressure header 2320 is disposed at a position which is diagonally symmetrical to the first high-pressure header 2310, it is not limited thereto, and the first and second high-pressure headers 2310 and 2320 may be disposed at positions which are not symmetrical to each other. In the exemplary embodiment, the diameters 2*r* and 2R of the first and second high-pressure headers 2310 and 2320 are relatively small, whereby a degree of freedom in disposition of the high-pressure headers may be enhanced.

The first low-pressure header 2410 forms a space extending from an upper surface of the body part 2000' in a thickness direction of the body part 2000'. Low-pressure fluid, i.e., high-temperature fluid, is drawn into the first low-pressure header 2410 so that the fluid can circulate through the second plates 2200. An inlet hole through which low-pressure fluid is drawn into the first low-pressure header 2410 is formed in the upper surface of the body part 2000'.

The second low-pressure header 2420 is formed at a position which is diagonally symmetrical to the first low-pressure header 2410. The second low-pressure header 2320 forms a space extending in the thickness direction of the body part 2000'. The second low-pressure header 2420 may retrieve fluid that has flowed through the second plates 2200. An outlet hole through which low-pressure fluid is retrieved from the second low-pressure header 2420 is formed in the upper surface of the body part 2000'.

An opening area of each of the first and second low-pressure headers 2410 and 2420 may be greater than an opening area of each of the first and second high-pressure headers 2310 and 2320.

Figure 13A:
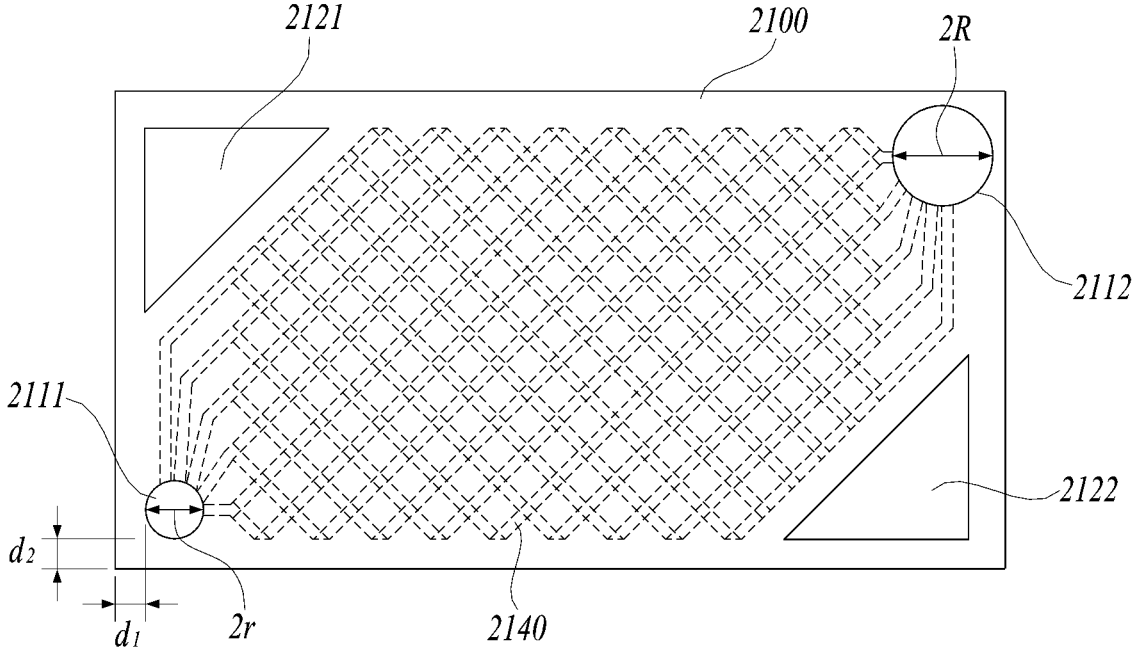
FIGS. 13A and 13B are diagrams illustrating first and second plates of the printed circuit heat exchanger in accordance with an exemplary embodiment.
Figure 13B:
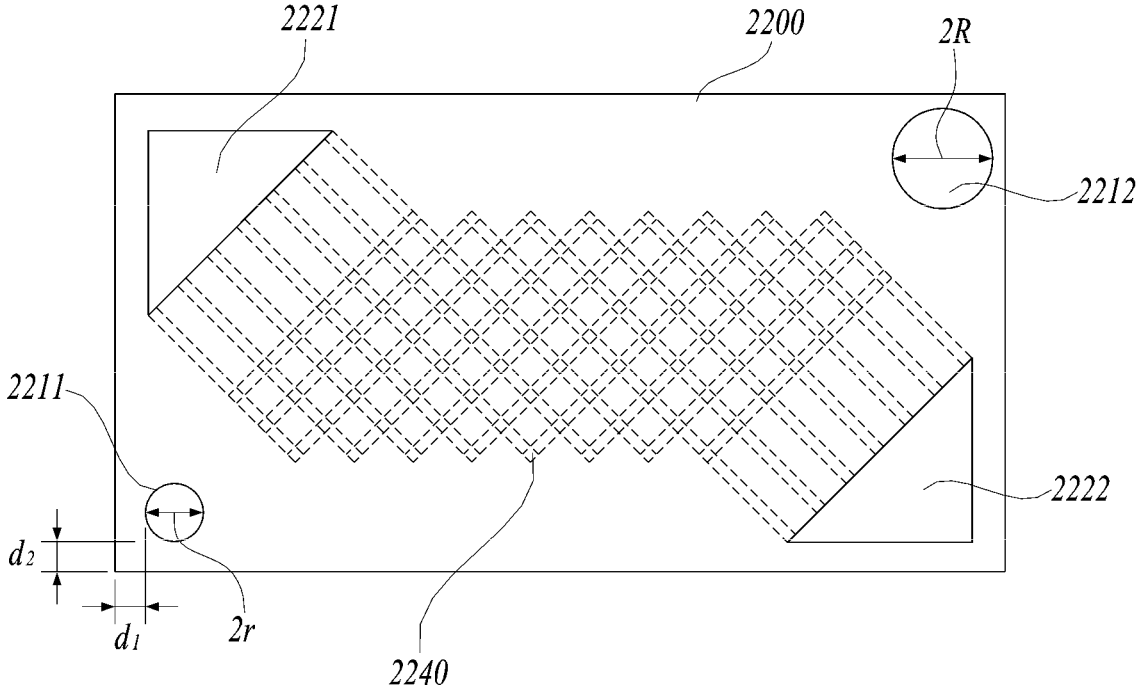

FIGS. 13A and 13B are diagrams illustrating first and second plates of the printed circuit heat exchanger in accordance with an exemplary embodiment.

Referring to FIG. 13A, the first plate 2100 has a rectangular shape and is formed of a first bonding plate formed by bonding a pair of upper and lower plates. First and second high-pressure header forming openings 2111 and 2112, first and second low-pressure header forming openings 2121 and 2122, and a plurality of first flow channels 2140 are formed in the first plate 2100.

The first and second high-pressure header forming openings 2111 and 2112 are disposed at positions symmetrical to each other based on a center point of the first plate 2100. When a plurality of first and second plates 2100 and 2200 are stacked, the first high-pressure header forming openings 2111 are connected into one space, thus forming the first high-pressure header 2310. Low-temperature or cryogenic high-pressure fluid is drawn into the first high-pressure header 2310. The first high-pressure header 2310 circulates the drawn high-pressure fluid through a plurality of flow channels 2140 of the first plate 2100.

The first high-pressure header forming opening 2111 is formed at a position spaced apart from each edge of the first plate 2100 by a predetermined distance. Spacing distances d1 and d2 are formed to be greater than a diameter 2*r* of the first high-pressure header forming opening 2111 to enable the first high-pressure header to reliably resist internal pressure when high-pressure fluid is drawn into the first high-pressure header. For example, if the diameter 2*r* of the first high-pressure header forming opening 2111 is 5 mm, the spacing distances d1 and d2 by which the first high-pressure header forming opening 2111 is spaced apart from the respective corresponding edges of the first plate 2100 may be designed to exceed 5 mm.

High-pressure fluid drawn into the first high-pressure header 2310 applies pressure to the interior of the body part 2000'. To resist the pressure applied to the periphery of the first high-pressure header 2310, a wall having a predetermined thickness should be formed on the periphery of the first high-pressure header 2310. Therefore, a flow channel cannot be disposed around the periphery of the first high-pressure header 2310. To overcome this, the first high-pressure header forming opening 2111 may be formed to have a minimized size. Because the first high-pressure header forming opening 2111 has a minimized diameter, the spacing distances d1 and d2 by which the first high-pressure header forming opening 2111 is spaced apart from the respective edges of the first plate 2100 may be further reduced. In this case, the flow channel arrangement area may be increased, whereby the efficiency of the heat exchanger may be further enhanced.

Furthermore, because the first high-pressure header 2310 is disposed at a position biased to one side on the body part 2000', the flow channel arrangement space and opposite extra space may be secured. Therefore, various changes in arranging and designing the flow channels are possible, and the heat exchanger may be further reduced in size and weight.

When the plurality of first and second plates 2100 and 2200 are stacked, the second high-pressure header forming openings 2112 are connected into one space, thus forming the second high-pressure header 2320. The second high-pressure header 2320 may retrieve fluid that has passed through the first flow channels 2140.

The second high-pressure header forming opening 2112 is formed at a position spaced apart from each edge of the first plate 2100 by a predetermined distance. Spacing distances d1 and d2 are formed to be greater than a diameter 2R of the second high-pressure header forming opening 2112 to enable the second high-pressure header 2320 to reliably resist internal pressure when high-pressure fluid flows through the second high-pressure header 2320. For example, if the diameter 2R of the second high-pressure header forming opening 2112 is 5 mm, the spacing distances d1 and d2 by which the second high-pressure header forming opening 2112 is spaced apart from the respective corresponding edges of the first plate 2100 may be designed to exceed 5 mm.

The second high-pressure forming opening 2112 may also be formed to have a minimized size. Because the second high-pressure header forming opening 2112 has a minimized diameter, the spacing distances d1 and d2 by which the second high-pressure header forming opening 2112 is spaced apart from the respective edges of the first plate 2100 may be further reduced. In this case, the flow channel arrangement area may be increased, whereby the efficiency of the heat exchanger may be further enhanced.

The diameter 2R of the second high-pressure header forming opening 2112 may be the same as that of the first high-pressure header forming opening 2111. In the exemplary embodiment of FIG. 13A, the diameter 2R of the second high-pressure header forming opening 2112 may be greater than the diameter 2*r* of the first high-pressure header forming opening 2111 because the pressure of fluid that has flowed through the first plate 2100 may be reduced according to required design of the heat exchanger.

The flow channels 2140 are formed in the first plate 2100. The first plate 2100 is formed by bonding two plates respectively having flow channels in surfaces thereof facing each other. In detail, the first plate 2100 may be formed of a first bonding plate, in which a plurality of flow channels 2140 each having a zigzag shape are formed adjacent to each other between the two plates that are bonded to each other, and which is formed such that some sections of each of the flow channels 2140 overlap with adjacent flow channels. The first bonding plate may include an upper plate having in a lower surface thereof a plurality of straight flow channels extending to one side oblique to a longitudinal direction, and a lower plate having in an upper surface thereof a plurality of straight flow channels extending to the other side oblique to the longitudinal direction, and may be formed by bonding the upper plate and the lower plate to each other such that the flow channels face each other.

The plurality of flow channels 2140 of the first plate 2100 are coupled at the opposite ends thereof respectively to the first high-pressure header forming opening 2111 and the second high-pressure header forming opening 2112. Fluid may be drawn from the first high-pressure header 2310, flow through the plurality of first flow channels 2140, and be retrieved into the second high-pressure header 2320.

First and second low-pressure header forming openings 2121 and 2122 are disposed on a diagonal line opposite to that for the first and second high-pressure header forming openings 2111 and 2112. The first and second low-pressure header forming openings 2121 and 2122 are disposed at positions symmetrical to each other based on the center point of the first plate 2100. When the plurality of first and second plates 2100 and 2200 are stacked, the first low-pressure header forming openings 2121 are connected into one space, thus forming a first low-pressure header 2410. When the plurality of first and second plates 2100 and 2200 are stacked, the second low-pressure header forming openings 2122 are connected into one space, thus forming a second low-pressure header 2420.

Referring to FIG. 13B, the second plate 2200 has a rectangular shape and is formed of a second bonding plate formed by bonding a pair of upper and lower plates. First and second high-pressure header forming openings (first and second openings) 2211 and 2212, first and second low-pressure header forming openings (third and fourth openings) 2221 and 2222, and a plurality of second flow channels 2240 are formed in the second plate 2200.

The first and second high-pressure header forming openings 2211 and 2212 are disposed at positions symmetrical to each other based on a center point of the second plate 2200. When a plurality of first and second plates 2100 and 2200 are stacked, the first high-pressure header forming openings 2211 are connected into one space, thus forming the first high-pressure header 2310.

When the plurality of first and second plates 2100 and 2200 are stacked, the second high-pressure header forming openings 2212 are connected into one space, thus forming the second high-pressure header 2320.

The first and second high-pressure header forming openings 2211 and 2212 are formed at positions spaced apart from corresponding edges of the second plate 2200 by a predetermined distance. Spacing distances d1 and d2 are formed to be greater than diameters 2*r* and 2R of the first and second high-pressure header forming openings 2211 and 2212. Each of the first and second high-pressure header forming openings 2211 and 2212 may be formed to have a minimized size.

First and second low-pressure header forming openings 2221 and 2222 are disposed on a diagonal line opposite to that for the first and second high-pressure header forming openings 2211 and 2212. The first and second low-pressure header forming openings 2221 and 2222 may be disposed at positions symmetrical to each other based on the center point of the second plate 2200. When the plurality of first and second plates 2100 and 2200 are stacked, the first low-pressure header forming openings 2221 are connected into one space, thus forming the first low-pressure header 2410. High-temperature low-pressure fluid is drawn into the first low-pressure header 2410. The first low-pressure header 2410 circulates the high-temperature fluid through the flow channels 2240 of each of the second plates 2200.

When the plurality of first and second plates 2100 and 2200 are stacked, the second low-pressure header forming openings 2222 are connected into one space, thus forming the second low-pressure header 2420. The second low-pressure header 2320 may retrieve fluid that has passed through the second flow channels 2240.

In the first and second low-pressure headers 2410 and 2420, low-pressure fluid flows, so that internal pressure applied to the body part 2000' is comparatively low. Therefore, walls that form the first and second low-pressure headers 2410 and 2420 may be thinner than the walls that form the first and second high-pressure headers 2310 and 2320. The distance between the first and second low-pressure header forming openings 2221 and 2222 and the corresponding edges of the body part 2000' may be less than the distances d1 and d2 between the first and second high-pressure header forming openings 2211 and 2212 and the corresponding edges of the body part 2000' An area of each of the first and second low-pressure header forming openings 2221 and 2222 may be greater than an area of each of the first and second high-pressure header forming opening 2211 and 2212.

The flow channels 2240 are formed in the second plate 2200. The second plate 2200 may be formed of a second bonding plate, in which a plurality of flow channels 2240 each having a zigzag shape are formed adjacent to each other between the two plates that are bonded to each other, and which is formed such that some sections of each of the flow channels 2140 overlap with adjacent flow channels. The second bonding plate may include an upper plate having in a lower surface thereof a plurality of straight flow channels extending to one side oblique to a longitudinal direction, and a lower plate having in an upper surface thereof a plurality of straight flow channels extending to the other side oblique to the longitudinal direction, and may be formed by bonding the upper plate and the lower plate to each other such that the flow channels face each other.

A plurality of second flow channels 2240 are disposed adjacent to each other. The plurality of second flow channels 2240 are coupled at the opposite ends thereof respectively to the first low-pressure header forming opening 2221 and the second low-pressure header forming opening 2222. Fluid may be drawn from the first low-pressure header 2410, flow through the plurality of second flow channels 2240, and be retrieved into the second low-pressure header 2420.

For example, the first and second plates 2100 and 2200 may be stacked at a ratio of 1:1, or may be stacked at a ratio of 2:1 or 1:2, as needed. Although this exemplary embodiment illustrates that two types of plates including the first and second plates 2100 and 2200 are stacked, it is not limited thereto. Depending on the type of fluid to flow through the plates, three or more types of plates may be stacked to form the heat exchanger.

According to the printed circuit heat exchanger in accordance with an exemplary embodiment, even if a portion of some of the flow channels having a three-dimensional shape is clogged with foreign substances, fluid may flow through other flow channels connected thereto. The heat exchange efficiency may be further enhanced compared to that of the related art straight flow channel or zigzag flow channel.

Figure 14:
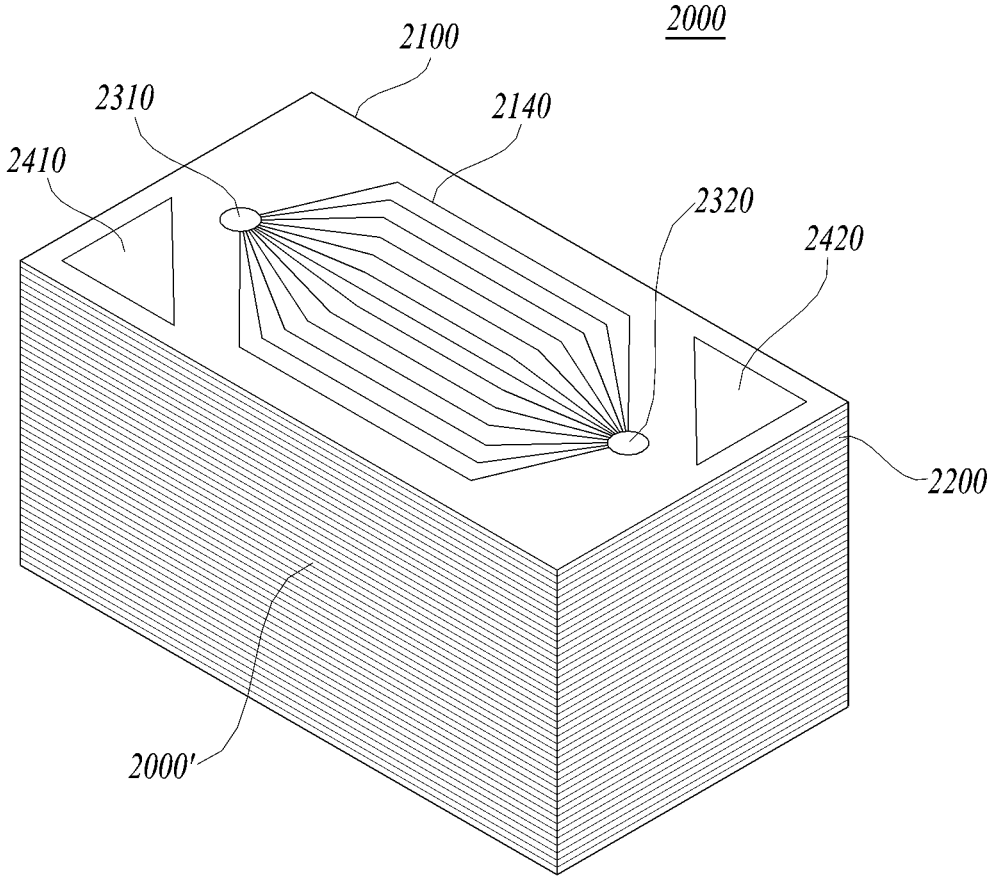
FIG. 14 is a diagram illustrating a printed circuit heat exchanger in accordance with an exemplary embodiment.

Referring to FIG. 14, in a heat exchanger 2000, first and second high-pressure headers 2310 and 2320 may be disposed on longitudinal opposite ends of the body part 2000'. In this case, low-pressure headers may be disposed at an empty perimeter side.

First high-pressure headers 2410 may be disposed in the longitudinal opposite ends, and two types of low-pressure headers may be disposed in a perimeter surface of the body part 2000'. This may be changed depending on a purpose of the heat exchanger or the type of fluid flowing the heat exchanger.

For example, all of the headers including high-pressure headers and low-pressure headers may be designed in an embedded type. Therefore, a welding process may be omitted. The exemplary embodiment is advantageous in that, because the welding process is omitted, additional cost may not occur, and related art problems occurring due to welding may be solved.

Figure 15:
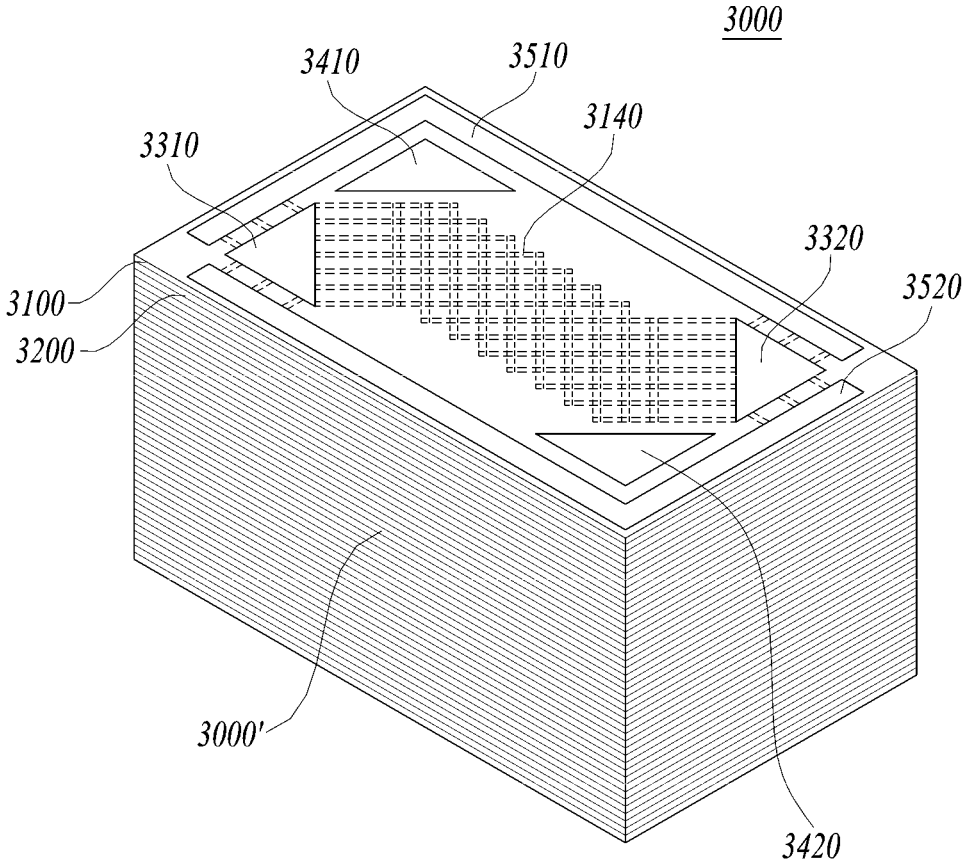
FIG. 15 is a diagram illustrating a printed circuit heat exchanger in accordance with an exemplary embodiment.
Figure 16A:
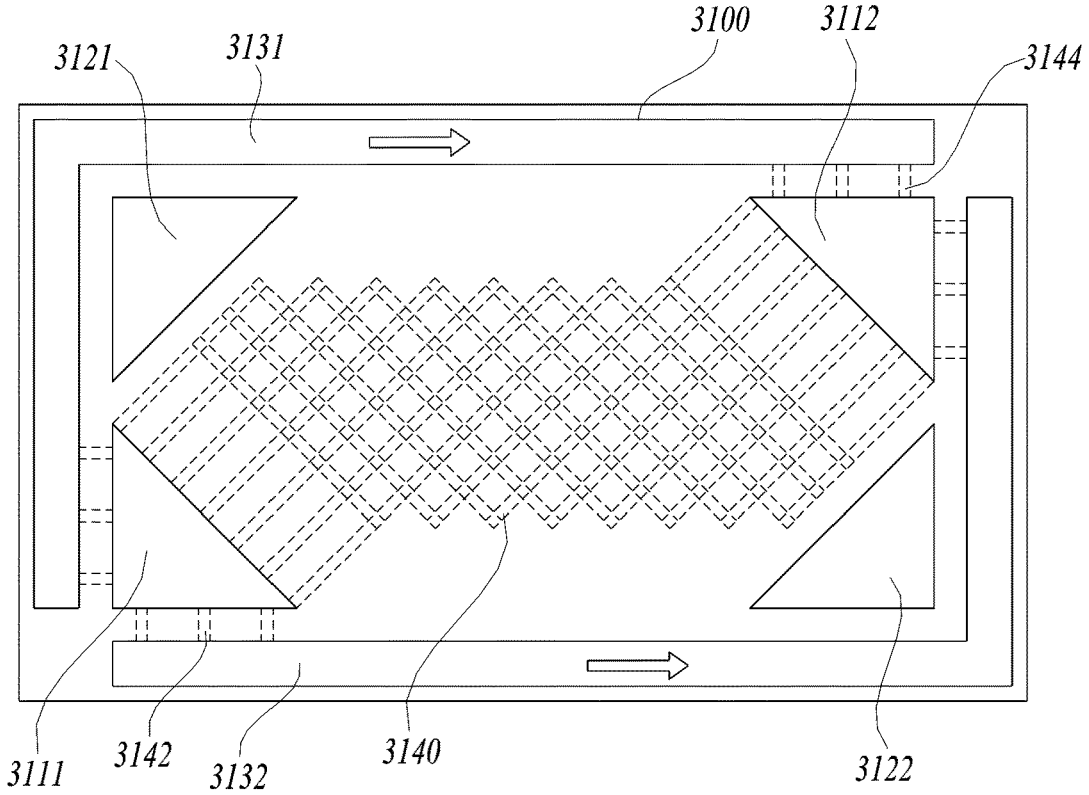
FIGS. 16A and 16B are diagrams illustrating first and second plates of the printed circuit heat exchanger in accordance with an exemplary embodiment.
Figure 16B:
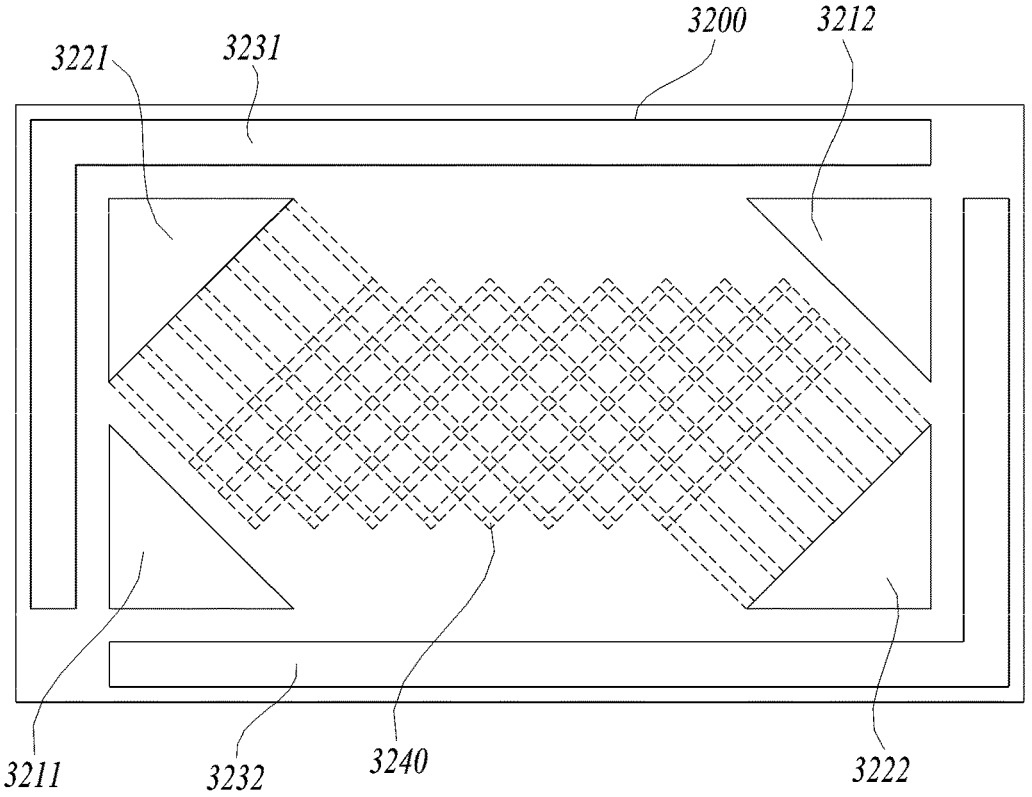

FIG. 15 is a diagram illustrating a printed circuit heat exchanger in accordance with an exemplary embodiment. FIGS. 16A and 16B are diagrams illustrating first and second plates of the printed circuit heat exchanger in accordance with an exemplary embodiment.

Referring to FIG. 15, a printed circuit heat exchanger 3000 may include a body part 3000', a first high-temperature header 3310, a second high-temperature header 3320, a first low-temperature header 3410, a second low-temperature header 3420, a first L-shaped cavity 3510, and a second L-shaped cavity 3520. The body part 3000' is formed by stacking first and second plates 3100 and 3200.

The first plate 3100 and the second plate 3200 may be formed of a first bonding plate and a second bonding plate each of which is formed by bonding a pair of upper and lower plates to each other. The first plates 3100 and the second plates 3200 may be alternately stacked. Different types of fluid respectively flow through flow channels 3140 and 3240 formed in the first and second plates 3100 and 3200. Low-pressure high-temperature fluid may flow on the first plate 3100, and high-pressure low-temperature fluid may flow on the second plate 3200. The first and second plates 3100 and 3200 may be made of heat resistant material such as stainless steel and a Ni-base alloy. Here, a plurality of first plates 3100 and a plurality of second plates 3200 are stacked and diffusion-bonded.

The first high-temperature header 3310 forms a space extending in a thickness direction of the body part 3000'. High-temperature fluid is drawn into the first high-temperature header 3310 so that the fluid can circulate through the first plates 3100.

The second high-temperature header 3320 is formed at a position which is diagonally symmetrical to the first high-temperature header 3310. The second high-temperature header 3320 forms a space extending in the thickness direction of the body part 3000'. The second high-temperature header 3320 may retrieve fluid that has flowed through the first plates 3100. The first low-temperature header 3410 forms a space extending in the thickness direction of the body part 3000'. Low-temperature fluid is drawn into the first low-temperature header 3410 so that the fluid can circulate through the second plates 3200.

The second low-temperature header 3420 is formed at a position which is diagonally symmetrical to the first low-temperature header 3410. The second low-temperature header 3420 forms a space extending in the thickness direction of the body part 3000'. The second low-temperature header 3420 may retrieve fluid that has flowed through the second plates 3200.

Although high-temperature fluid is drawn into the first high-temperature header 3310 and the second high-temperature header 3320, relatively low pressure is applied thereto. Although low-temperature fluid is drawn into the first low-temperature header 3410 and the second low-temperature header 3420, relatively high pressure is applied thereto. Thus, the first high-temperature header 3310 and the second high-temperature header 3320 may be respectively referred to as a first low-pressure header and a second low-pressure header. The first low-temperature header 3410 and the second low-temperature header 3420 may be respectively referred to as a first high-pressure header and a second high-pressure header.

The first L-shaped cavity 3510 is disposed in a perimeter of the body part 3000' and forms a space extending to a predetermined depth in a thickness direction of the body part 3000'. The first L-shaped cavity 3510 is filled from one end thereof with high-temperature fluid transmitted from the first high-temperature header 3310. The fluid that fills the first L-shaped cavity 3510 is retrieved from the other end of the first L-shaped cavity 3510 into the second high-temperature header 3320.

The second L-shaped cavity 3520 is disposed in the perimeter of the body part 3000' at a position symmetrical to the first L-shaped cavity 3510 and forms a space extending to a predetermined depth in the thickness direction of the body part 3000'. The second L-shaped cavity 3520 is filled from one end thereof with high-temperature fluid transmitted from the first high-temperature header 3310. The fluid that fills the second L-shaped cavity 3520 is retrieved from the other end of the second L-shaped cavity 3520 into the second high-temperature header 3320.

As illustrated in FIG. 16A, the first plate 3100 has a rectangular shape. First and second high-temperature header forming openings 3111 and 3112, first and second low-temperature header forming openings 3121 and 3122, first and second L-shaped openings 3131 and 3132, a plurality of first flow channels 3140, and a plurality of leakage flow channels 3142 and 3144 are formed in the first plate 3100.

The first plate 3100 may be formed of a first bonding plate, in which a plurality of flow channels 3140 each having a zigzag shape are formed adjacent to each other between the two plates that are bonded to each other, and which is formed such that some sections of each of the flow channels 3140 overlap with adjacent flow channels. The first bonding plate may include an upper plate having in a lower surface thereof a plurality of straight flow channels extending to one side oblique to a longitudinal direction, and a lower plate having in an upper surface thereof a plurality of straight flow channels extending to the other side oblique to the longitudinal direction, and may be formed by bonding the upper plate and the lower plate to each other such that the flow channels face each other.

The first and second high-temperature header forming openings 3111 and 3112 are disposed at positions symmetrical to each other based on a center point of the first plate 3100. When the plurality of first and second plates 3100 and 3200 are stacked, the first high-temperature header forming openings 3111 are connected into one space, thus forming the first high-temperature header 3310. High-temperature fluid is drawn into the first high-temperature header 3310. The first high-temperature header 3310 circulates the drawn high-temperature fluid through the flow channels 3140 of each of the first plates 3100.

When the plurality of first and second plates 3100 and 3200 are stacked, the second high-temperature header forming openings 3112 are connected into one space, thus forming the second high-temperature header 3320. The second high-temperature header 3320 may retrieve fluid that has passed through the first flow channels 3140.

A plurality of first flow channels 3140 are disposed adjacent to each other and are coupled at the opposite ends thereof respectively to the first high-temperature header forming opening 3111 and the second high-temperature header forming opening 3112. Fluid may be drawn from the first high-temperature header 3310, flow through the plurality of first flow channels 3140, and be retrieved into the second high-temperature header 3320.

First and second low-temperature header forming openings 3121 and 3122 are disposed on a diagonal line opposite to that for the first and second high-temperature header forming openings 3111 and 3112. The first and second low-temperature header forming openings 3121 and 3122 are disposed at positions symmetrical to each other based on the center point of the first plate 3100. When the plurality of first and second plates 3100 and 3200 are stacked, the first low-temperature header forming openings 3121 are connected into one space, thus forming the first low-temperature header 3410. When the plurality of first and second plates 3100 and 3200 are stacked, the second low-temperature header forming openings 3122 are connected into one space, thus forming the second low-temperature header 3420.

The first L-shaped opening 3131 is formed in the perimeter of the first plate 3100. The second L-shaped opening 3132 is formed at a position symmetric to the first L-shaped opening 3131 based on the center point of the first plate 3100. The first and second L-shaped openings 3131 and 3132 are disposed along the perimeter of the first plate 3100 having a rectangular shape. To secure the durability of the plates when the plates are bonded to each other, the first and second L-shaped openings 3131 and 3132 are disposed at positions spaced apart from peripheral edges of the first plate 3100 by a predetermined distance. Portions of the perimeter of the first plate 3100 in which no opening is formed function as connection supports for supporting the plurality of plates 3100 and 3200 when the first and second plates 3100 and 3200 are stacked.

The first L-shaped opening 3131 is connected at one end thereof to the first high-temperature header forming opening 3111 through the leakage flow channel 3142. When the plurality of first and second plates 3100 and 3200 are stacked, the first L-shaped openings 3131 are connected into one space, thus forming the first L-shaped cavity 3510 which is an L-shaped water tub. Some of high-temperature fluid drawn into the first high-temperature header 3310 may fill the first L-shaped cavity 3510 through the first leakage flow channels 3142 so that high-temperature fluid remains in the first L-shaped cavity 3510. In the exemplary embodiment, at least one or more first leakage flow channels 3142 are formed, and the number of first leakage flow channels 3142 may be changed, as needed. For example, the number of first leakage flow channels 3142 may be designed to change depending on the type of low-temperature fluid to be used for heat exchange.

A sum of the surface areas of the first and second L-shaped openings 3131 and 3132 may be 1% to 10% of the surface area of the entire flow channels. This is because that, in the case in which the sum of the surface areas of the first and second L-shaped openings 3131 and 3132 exceeds 10% of the surface area of the entire flow channels, an area in which the flow channels can be disposed in the first plate 3100 is excessively reduced, so that unnecessary space is used to prevent the fluid channels from freezing, whereby the entire efficiency of the heat exchanger may be reduced.

The first L-shaped opening 3131 is connected at the other end thereof to the second high-temperature header forming opening 3112 through the second leakage flow channels 3144. High-temperature fluid that flows in the first L-shaped cavity 3510 is retrieved into the second high-temperature header 3320 through the second leakage fluid channels 3144. In the exemplary embodiment, at least one or more second leakage flow channels 3144 are formed, and the number of second leakage flow channels 3144 may be changed, as needed. For example, the number of second leakage flow channels 3144 may be designed to change depending on the type of low-temperature fluid to be used for heat exchange.

The second L-shaped cavity 3520 may also be configured in the same manner as that of the first L-shaped cavity 3510, therefore, repetitive description thereof will be omitted.

As illustrated in FIG. 16B, the second plate 3200 has a rectangular shape. First and second high-pressure header forming openings (first and second openings) 3211 and 3212, first and second low-pressure header forming openings (third and fourth openings) 3221 and 3222, first and second L-shaped openings 3231 and 3232, and a plurality of second flow channels 3240 are formed in the second plate 3200.

The second plate 3200 may be formed of a second bonding plate, in which a plurality of flow channels 3240 each having a zigzag shape are formed adjacent to each other between the two plates that are bonded to each other, and which is formed such that some sections of each of the flow channels 3240 overlap with adjacent flow channels. The second bonding plate may include an upper plate having in a lower surface thereof a plurality of straight flow channels extending to one side oblique to a longitudinal direction, and a lower plate having in an upper surface thereof a plurality of straight flow channels extending to the other side oblique to the longitudinal direction, and may be formed by bonding the upper plate and the lower plate to each other such that the flow channels face each other.

The first and second high-temperature header forming openings 3211 and 3212 are disposed at positions symmetrical with each other based on a center point of the second plate 3200. When the plurality of first and second plates 3100 and 3200 are stacked, the first high-temperature header forming openings 3111 are connected into one space, thus forming the first high-temperature header 3310.

When the plurality of first and second plates 3100 and 3200 are stacked, the second high-temperature header forming openings 3112 are connected into one space, thus forming the second high-temperature header 3320.

First and second low-temperature header forming openings 3221 and 3222 are disposed on a diagonal line opposite to that for the first and second high-temperature header forming openings 3211 and 3212. The first and second low-temperature header forming openings 3221 and 3222 are disposed at positions symmetrical to each other based on the center point of the second plate 3200. When the plurality of first and second plates 3100 and 3200 are stacked, the first low-temperature header forming openings 3221 are connected into one space, thus forming the first low-temperature header 3410. Low-temperature or cryogenic fluid is drawn into the first low-temperature header 3410. The first low-temperature header 3410 circulates the drawn low-temperature or cryogenic fluid through the flow channels 3240 of each of the second plates 3200.

When the plurality of first and second plates 3100 and 3200 are stacked, the second low-temperature header forming openings 3222 are connected into one space, thus forming the second low-temperature header 3420. The second low-temperature header 3420 may retrieve fluid that has passed through the second flow channels 3240.

A plurality of second flow channels 3240 are disposed adjacent to each other and are coupled at the opposite ends thereof respectively to the first low-temperature header forming opening 3221 and the second low-temperature header forming opening 3222. Fluid may be drawn from the first low-temperature header 3410, flow through the plurality of second flow channels 3240, and be retrieved into the second low-temperature header 3420.

A first L-shaped opening 3231 is formed in the perimeter of the second plate 3200. A second L-shaped opening 3232 is formed at a position symmetric to the first L-shaped opening 3231 based on the center point of the second plate 3200. The first and second L-shaped openings 3231 and 3232 are disposed along the perimeter of the second plate 3200 having a rectangular shape. To secure the durability of the plates when the plates are bonded to each other, the first and second L-shaped openings 3231 and 3232 are disposed at positions spaced apart from peripheral edges of the second plate 3200 by a predetermined distance.

A sum of surface areas of the first and second L-shaped openings 3231 and 3232 may be 1% to 10% of the surface area of the entire flow channels. This is because that, in the case in which the sum of the surface areas of the first and second L-shaped openings 3231 and 3232 exceeds 10% of the surface area of the entire flow channels, an area in which the flow channels can be disposed in the second plate 3200 is excessively reduced, so that unnecessary space is used to prevent the fluid channels from freezing, whereby the entire efficiency of the heat exchanger is reduced.

According to the printed circuit heat exchanger in accordance with an exemplary embodiment, even if a portion of some of the flow channels having a three-dimensional shape is clogged with foreign substances, fluid may flow through other flow channels connected thereto. The heat exchange efficiency may be further enhanced compared to that of the related art straight flow channel or zigzag flow channel.

Figure 17:
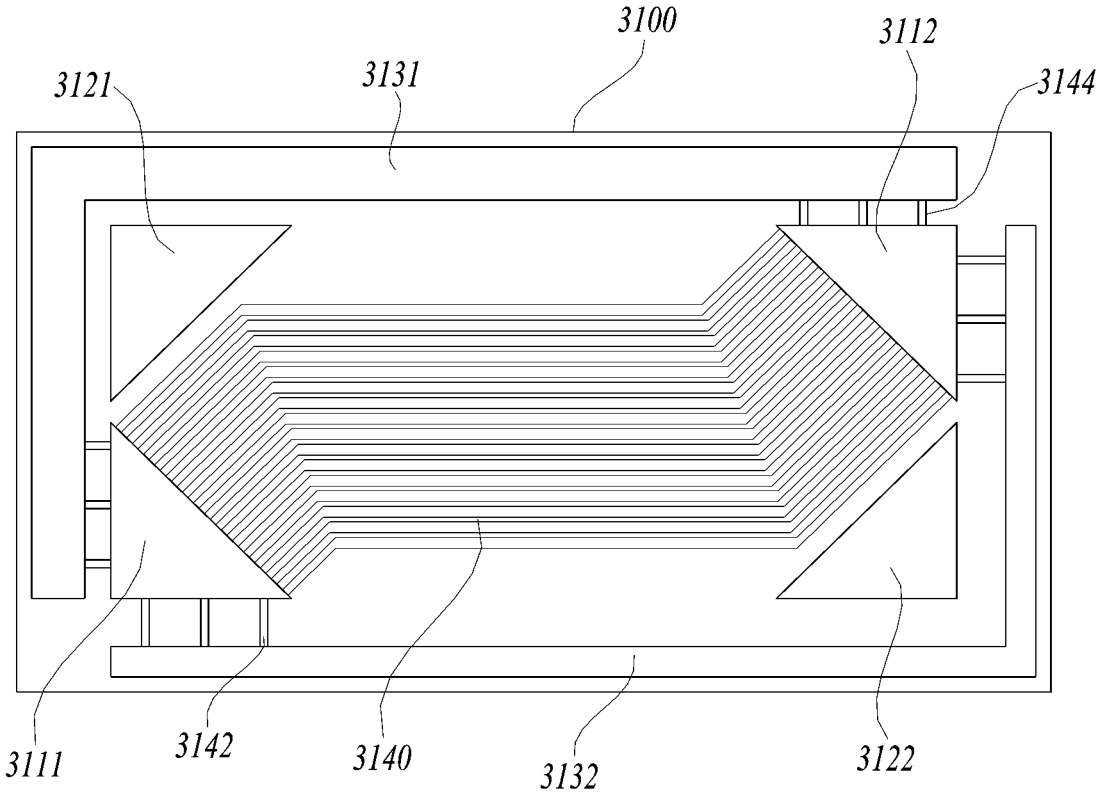
FIG. 17 is a diagram illustrating a first bonding plate of the printed circuit heat exchanger in accordance with an exemplary embodiment.
Figure 18A:
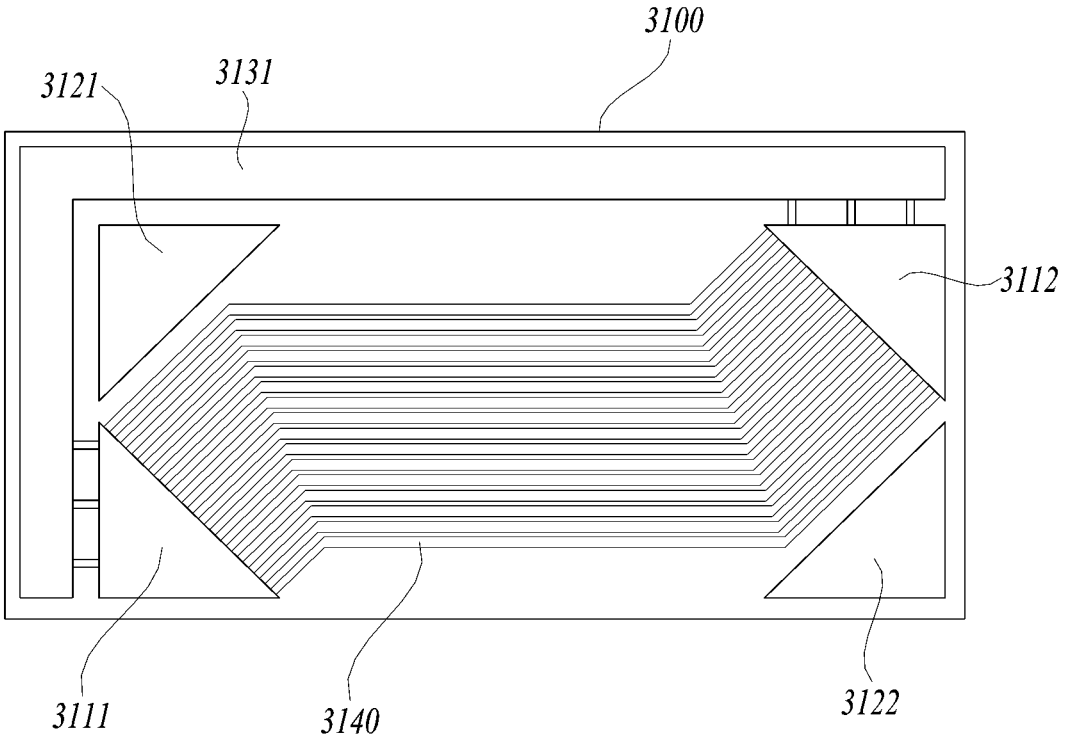
FIGS. 18A and 18B are diagrams illustrating first and second plates of the printed circuit heat exchanger in accordance with an exemplary embodiment.
Figure 18B:
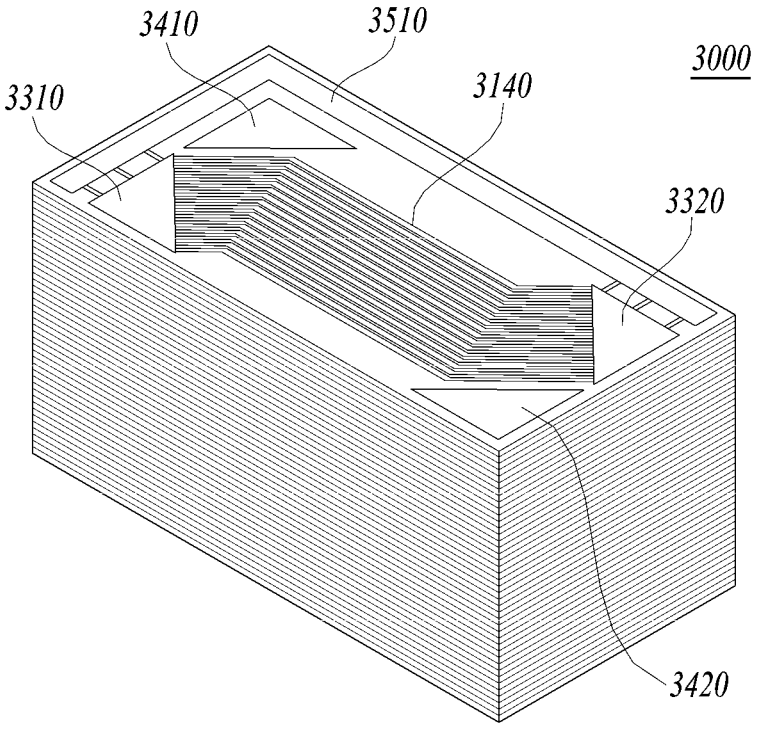

FIG. 17 is a diagram illustrating a first plate for printed circuit heat exchangers in accordance with an exemplary embodiment. FIGS. 18A and 18B are diagrams illustrating a first plate for printed circuit heat exchangers and a printed circuit heat exchanger in accordance with an exemplary embodiment.

Referring to FIG. 17, a first L-shaped opening 3131 may be greater in surface area than a second L-shaped opening 3132. The first L-shaped opening 3131 is disposed adjacent to the first low-temperature header 3410 into which low-temperature fluid is drawn. It is possible that a vicinity of the first low-temperature header 3410 is frozen by fluid drawn into the first low-temperature header 3410. To avoid this, a size of the first L-shaped cavity 3510 disposed adjacent to the first low-temperature header 3410 is increased, so that the flow channel arrangement area of the heat exchanger can be secured and anti-freezing effect can also be provided.

Referring to FIG. 18A, an L-shaped opening may be disposed in only one portion of the vicinity of the first low-temperature header 3410. That is, only a first L-shaped opening 3131 may be formed in the first plate 3100. Because the first L-shaped opening 3131 is disposed only in the vicinity of the first low-temperature header 3410 which is likely to be frozen by fluid drawn into the first low-temperature header 3410, the flow channel arrangement area of the heat exchanger 3000 may be reliably secured.

FIG. 18B illustrates a printed circuit heat exchanger provided with only one L-shaped cavity 3510. In this case, the heat exchanger 3000 may be further reduced in size compared to that of the case in which two L-shaped cavities 3510 and 3520 are provided.

Figure 19:
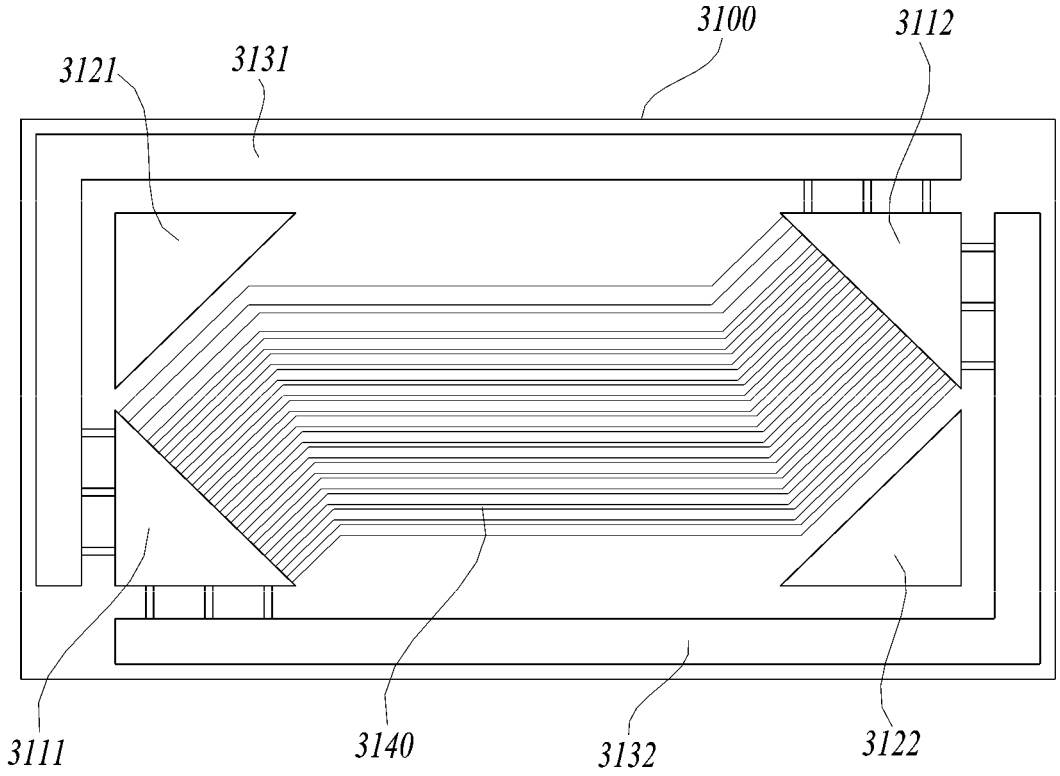
FIG. 19 is a diagram illustrating a printed circuit heat exchanger with some first flow channels each having an increased width in accordance with an exemplary embodiment.
Figure 20:
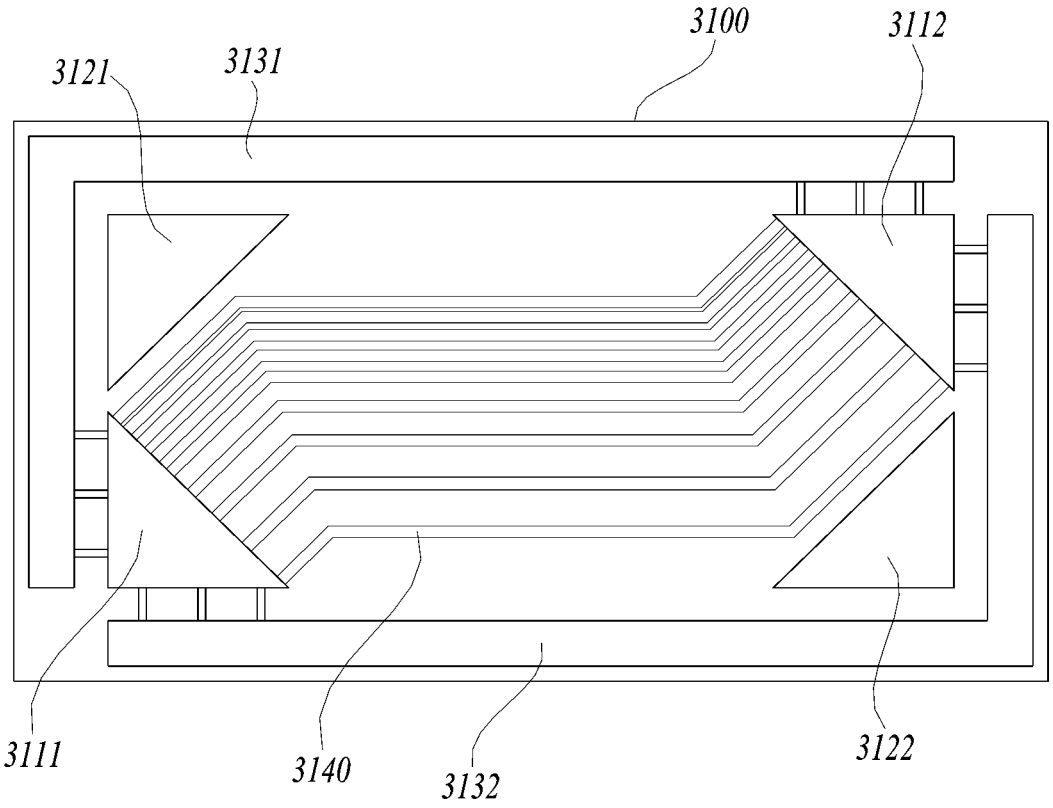
FIG. 20 is a diagram illustrating a printed circuit heat exchanger with some first flow channels arranged at reduced intervals in accordance with an exemplary embodiment.

FIG. 19 is a diagram illustrating a printed circuit heat exchanger with some first flow channels each having an increased width in accordance with an exemplary embodiment, and FIG. 20 is a diagram illustrating a printed circuit heat exchanger with some first flow channels arranged at reduced intervals in accordance with an exemplary embodiment.

Flow channels disposed in the vicinity of the first low-temperature header 3410 may be frozen by low-temperature or cryogenic fluid drawn into the first low-temperature header 3410. When the first plates 3100 and the second plates 3200 are stacked, first flow channels 3140 formed in each of the first plates 3100 and second flow channels 3240 formed in each of the second plates 3200 are disposed to be symmetrical to each other. In other words, in the vicinity of the first low-temperature header 3410, heat exchange cannot be sufficiently performed between an inlet into which fluid is drawn from the first low-temperature header 3410 and an inlet into which fluid is drawn from the first high-temperature header 3310. Therefore, flow channels disposed in the vicinity of the first low-temperature header 3410 may freeze and may be formed to be greater in width than flow channels disposed at an inner side so that the thermal capacity of the flow channels disposed in the vicinity can be increased. As illustrated in FIG. 19, the first flow channel 3140 that is adjacent to the first low-temperature header forming opening 3121 may be formed to have an increased width.

Referring to FIG. 20, an interval between the first flow channels 3140 that are adjacent to the first low-temperature header forming opening 3121 is less than an interval between the flow channels that are disposed at the inner side so that a larger amount of high-temperature fluid can flow through the vicinity of the first low-temperature header forming opening 3121 compared to that of the second flow channels 3240 disposed in an adjacent layer.

The depth of the first flow channel 3140 that is adjacent to the first low-temperature header forming opening 3121 may be formed to be greater than that of the flow channels disposed at the inner side so that the thermal capacity of the flow channel 3140 that is adjacent to the first low-temperature header forming opening 3121 can be increased. For example, if the depth of each of the inside flow channels is 1 mm, the depth of the first flow channel 3140 that is adjacent to the first low-temperature header forming opening 3121 may range from 1.5 mm to 2 mm.

Figure 21A:
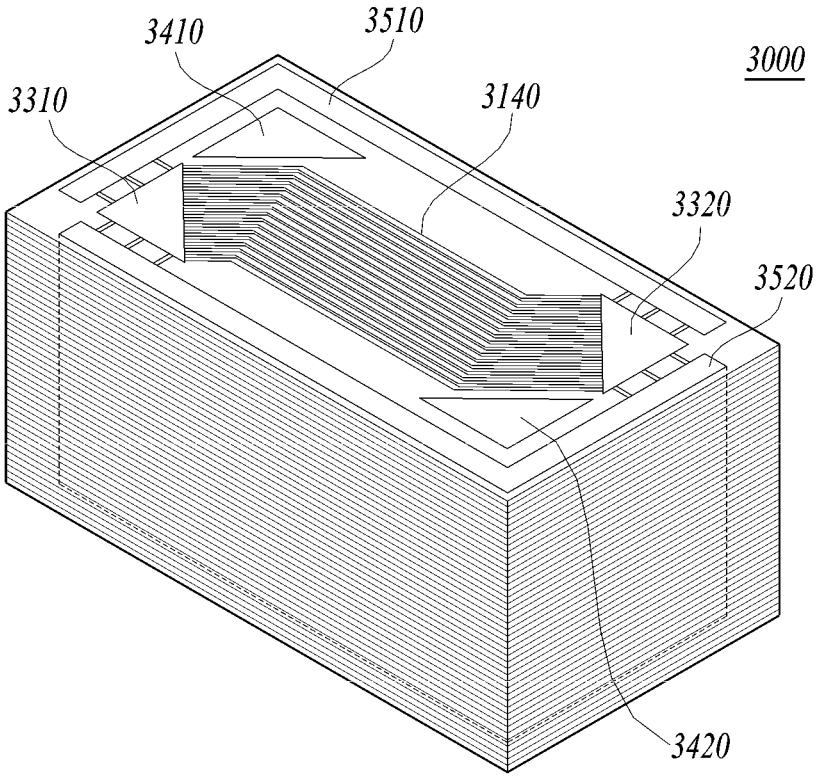
FIGS. 21A and 21B are diagrams illustrating printed circuit heat exchangers with water tubs having different depths in accordance with exemplary embodiments.
Figure 21B:
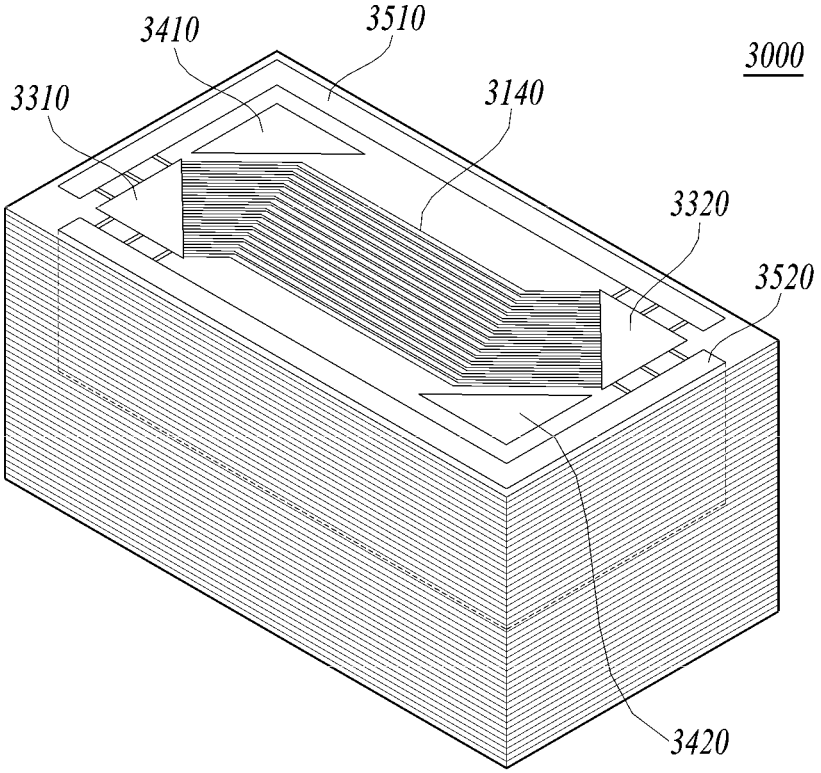

FIGS. 21A and 21B are diagrams illustrating printed circuit heat exchangers with water tubs having different depths in accordance with exemplary embodiments.

Referring to FIGS. 21A and 21B, first and second L-shaped water tubs may be formed along the whole of the height of the body part 3000', or may be formed to have heights corresponding to a half or less of the height of the body part 3000'.

For example, if about 400 of first and second plates 3100 and 3200 are stacked, both the first L-shaped openings 3131 and the second L-shaped openings 3132 may be formed in about 200 of first and second plates 3100 and 3200 that are disposed in an upper portion of the heat exchanger, and neither the first L-shaped openings 3131 nor the second L-shaped openings 3132 may be formed in the other about 200 of first and second plates 3100 and 3200 that are disposed in a lower portion of the heat exchanger. Because the L-shaped openings 3131 and 3132 are formed in only some layers, the flow channel arrangement area may be secured in the lower portion of the heat exchanger. In the exemplary embodiment, the depth of the first L-shaped cavity 3510 and the depth of the second L-shaped cavity 3520 may be designed to be different from each other. For example, the first L-shaped cavity 3510 may be formed to be deeper than the second L-shaped cavity 3520.

Figure 22:
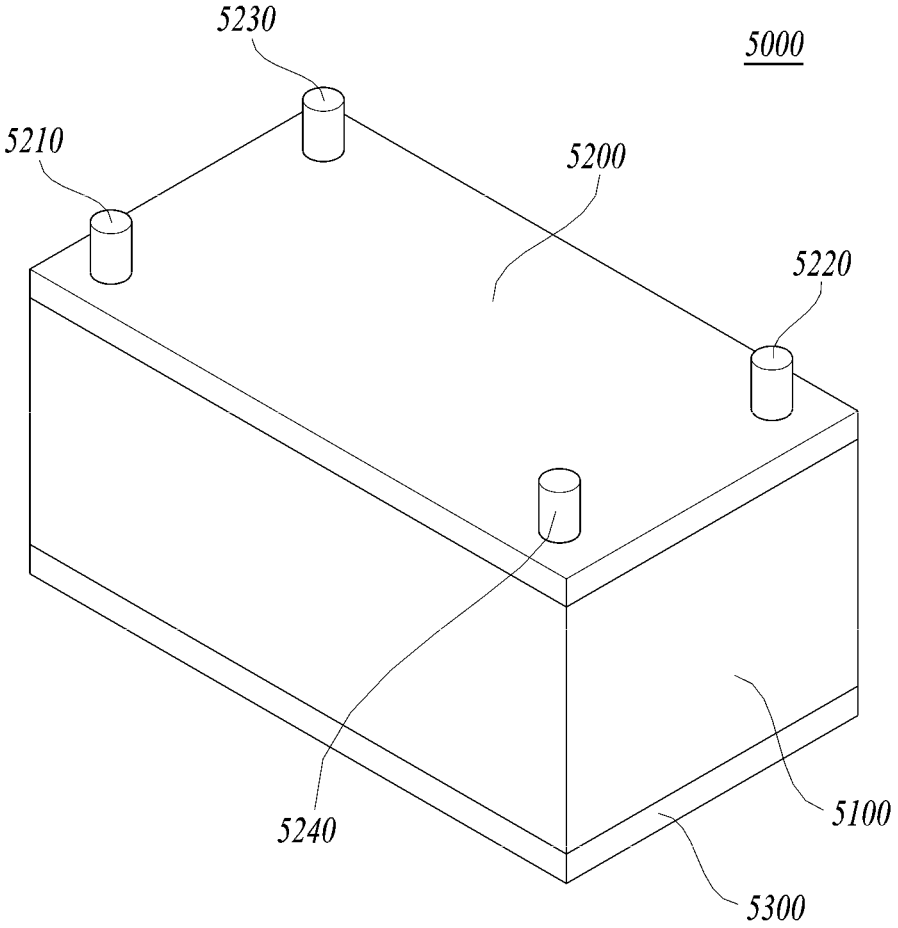
FIG. 22 is a diagram illustrating a heat exchange device in accordance with an exemplary embodiment.

FIG. 22 is a diagram illustrating a heat exchange device in accordance with an exemplary embodiment.

Referring to FIG. 22, the heat exchange device 5000 may include a printed circuit heat exchanger 5100, an upper cover 5200, and a lower cover 5300.

The printed circuit heat exchanger 5100 is formed by alternately stacking first and second plates 3100 and 3200. Header forming openings and L-shaped openings are formed in the first and second plates 3100 and 3200. 40 to 50 plates, maximally, 500 plates, may be stacked and diffusion-bonded, so that the printed circuit heat exchanger 5100 is formed with a plurality of headers and L-shaped cavities by the bonding. The upper cover 5200 is mounted to an upper part of the printed circuit heat exchanger 5100 formed by stacking and bonding the plates. The lower cover 5300 is mounted to a lower part of the printed circuit heat exchanger 5100. The upper cover 5200 and the lower cover 5300 function to stably fix the plurality of plates 3100 and 3200 bonded to each other. The upper cover 5200 and the lower cover 5300 may be made of the same material, e.g., stainless steel, as that of the plates of the printed circuit heat exchanger 5100.

The upper cover 5200 is provided with a high-temperature fluid supply port 5210, a high-temperature fluid retrieve port 5220, a low-temperature fluid supply portion 5230, and a low-temperature fluid retrieve port 5240 to supply fluid to the headers of the printed circuit heat exchanger 5100 or retrieve the fluid therefrom.

In accordance with one or more exemplary embodiments, even if some flow channels of a printed circuit heat exchanger are clogged with dust or foreign substances, fluid may flow through other flow channels adjacent to the clogged flow channels, whereby the transfer of fluid through the corresponding flow channels may be prevented from being restricted.

In accordance with one or more exemplary embodiments, the length of a heat transfer path of the printed circuit heat exchanger is increased, so that the heat transfer efficiency may be enhanced.

In accordance with one or more exemplary embodiments, an opening forming a high-pressure header is formed in a plate which forms a printed circuit heat exchanger. Thus, the high-pressure header may be formed using a simple configuration, and a separate welding process may be omitted.

In accordance with one or more exemplary embodiments, the high-pressure header is disposed in the heat exchanger, so that the space in the heat exchanger may be efficiently used, and space for the structural integrity may be minimized.

In accordance with one or more exemplary embodiments, a water tub through which fluid flows may be provided in the perimeter of the printed circuit heat exchanger. Thereby, the flow channels may be prevented from freezing due to low-temperature fluid, or accessory components may be prevented from being damaged due to low-temperature fluid.

While exemplary embodiments have been described with reference to the accompanying drawings, it will be apparent to those skilled in the art that various changes or modifications in form and details may be made therein without departing from the spirit and scope as defined in the appended claims. Therefore, the description of the exemplary embodiments should be construed in a descriptive sense and not to limit the scope of the claims, and many alternatives, modifications, and variations will be apparent to those skilled in the art.

What is claimed is:

1. A printed circuit heat exchanger comprising:

a first bonding plate formed of two plates bonded to each other; and a second bonding plate formed of two plates bonded to each other, wherein the first bonding plate and the second bonding plate are alternately stacked, and wherein the first bonding plate comprises:

an upper plate including a flat surface in which a plurality of upper plate flow channels are formed, each of the plurality of upper plate flow channels including an upper plate inlet and an upper plate straight flow channel communicating with the upper plate inlet, the upper plate inlet extending in a longitudinal direction of the upper plate and including a first end extending to a first edge of the upper plate and a second end opposite to the first end, the upper plate straight flow channel extending from the second end of the upper plate inlet toward a second edge of the upper plate obliquely with respect to the longitudinal direction of the upper plate, the first and second edges of the upper plate being orthogonal to each other; and a lower plate bonded to the upper plate, the lower plate including a flat surface in which a plurality of lower plate flow channels are formed, each of the plurality of lower plate flow channels including a lower plate inlet and a lower plate straight flow channel communicating with the lower plate inlet, the lower plate inlet extending in a longitudinal direction of the lower plate and including a first end extending to a first edge of the lower plate and a second end opposite to the first end, the lower plate straight flow channel extending from the second end of the lower plate inlet toward a second edge of the lower plate obliquely with respect to the longitudinal direction of the lower plate, the first and second edges of the lower plate being orthogonal to each other, wherein the upper and lower plates are bonded to each other such that their flat surfaces face each other, such that the upper plate inlet coincides with the lower plate inlet in a stacking direction of the first and second bonding plates, and such that the upper plate straight flow channel forms an overlapping section with the lower plate straight flow channel, wherein the second bonding plate comprises an upper plate including a flat surface in which a plurality of upper plate flow channels are formed and a lower plate bonded to the upper plate and including a flat surface in which a plurality of lower plate flow channels are formed, each of the plurality of upper plate flow channels including an upper plate inlet, and each of the plurality of lower plate flow channels including a lower plate inlet, wherein each of the first and second bonding plates has a rectangular shape, inlets of the upper and lower plates of the first bonding plate are parallel to long sides of the first bonding plate, and inlets of the upper and lower plates of the second bonding plate are parallel to short sides of the second bonding plate.

2. The printed circuit heat exchanger according to claim 1, wherein the plates of each of the first bonding plate and the second bonding plate are made of a heat resistant material including stainless steel and a nickel-base alloy, and wherein the plurality of flow channels are formed in respective flat surfaces by etching a fine pattern in the heat resistant material including stainless steel and a nickel-base alloy.

3. The printed circuit heat exchanger according to claim 1, wherein the upper and lower plates bonded to each other form a flow channel pattern connecting each of the plurality of lower plate inlets and each of the plurality of upper plate inlets to each other.

4. The printed circuit heat exchanger according to claim 3, wherein the flow channel pattern connects each of the plurality of lower plate inlets and each of the plurality of upper plate inlets to each other through a first zigzag-shaped flow channel formed by the overlapping section of each of the plurality of upper plate flow channels and each of the plurality of lower plate flow channels.

5. The printed circuit heat exchanger according to claim 4, wherein the first zigzag-shaped flow channel is disposed adjacent to a second zigzag-shaped flow channel to form a rhombus flow channel in a plan view by overlapping the first and second zigzag-shaped flow channels at an intersection occurring at vertices of the first and second zigzag-shaped flow channels.

6. The printed circuit heat exchanger according to claim 1, wherein each of the plurality of upper plate flow channels of the second bonding plate includes:

a plurality of upper plate straight flow channels extending toward a first edge of the upper plate obliquely with respect to a longitudinal direction of the upper plate, and a plurality of upper plate inlets respectively communicating with an end of each of the plurality of upper plate straight flow channels, each of the plurality of upper plate inlets including a first end and a second end opposite to the first end, the first end respectively communicating with the end of each of the plurality of upper plate straight flow channels and the second end extending to the first edge of the upper plate, and wherein each of the plurality of lower plate flow channels of the second bonding plate includes:

a plurality of lower plate straight flow channels extending toward a first edge of the lower plate obliquely with respect to a longitudinal direction of the upper plate, and a plurality of lower plate inlets respectively communicating with an end of each of the plurality of lower plate straight flow channels, each of the plurality of lower plate inlets including a first end and a second end opposite to the first end, the first end respectively communicating with the end of each of the plurality of lower plate straight flow channels and the second end extending to the first edge of the lower plate.

7. The printed circuit heat exchanger according to claim 1, wherein the plurality of upper plate flow channels of the first bonding plate and the plurality of lower plate flow channels of the first bonding plate are configured to transmit a flow of high-temperature fluid including ethylene glycol (EG) or water, and wherein the plurality of upper plate flow channels of the second bonding plate and the plurality of lower plate flow channels of the second bonding plate are configured to transmit a flow of low-temperature fluid including a cryogenic fluid.

8. The printed circuit heat exchanger according to claim 7, wherein the first bonding plate and the second bonding plate are stacked at a ratio of two first bonding plates for every one second bonding plate.

9. The printed circuit heat exchanger according to claim 1, wherein each of the plurality of upper plate flow channels further includes an upper plate outlet and an upper plate straight flow channel communicating with the upper plate outlet, the upper plate outlet extending in the longitudinal direction of the upper plate and including a third end extending to a third edge of the upper plate and a fourth end opposite to the third end, the upper plate straight flow channel extending from the fourth end of the upper plate outlet toward a fourth edge of the upper plate obliquely with respect to the longitudinal direction of the upper plate, the third and fourth edges of the upper plate being orthogonal to each other, and wherein each of the plurality of lower plate flow channels further includes a lower plate outlet and a lower plate straight flow channel communicating with the lower plate outlet, the lower plate outlet extending in the longitudinal direction of the lower plate and including a third end extending to a third edge of the lower plate and a fourth end opposite to the third end, the upper plate straight flow channel extending from the fourth end of the lower plate outlet toward a fourth edge of the lower plate obliquely with respect to the longitudinal direction of the lower plate, the third and fourth edges of the lower plate being orthogonal to each other.

10. The printed circuit heat exchanger according to claim 9, wherein the upper and lower plates are bonded to each other such that the upper plate outlet coincides with the lower plate outlet in the stacking direction and such that the upper plate straight flow channel forms an overlapping section with the lower plate straight flow channel.

11. A printed circuit heat exchanger comprising:

a first bonding plate formed of two plates bonded to each other; and a second bonding plate formed of two plates bonded to each other, wherein the first bonding plate and the second bonding plate are alternately stacked; and wherein the second bonding plate comprises:

an upper plate including a flat surface in which a plurality of upper plate flow channels are formed, and a lower plate bonded to the upper plate, the lower plate including a flat surface in which a plurality of lower plate flow channels are formed, wherein each of the plurality of upper plate flow channels includes:

a first plurality of upper plate straight flow channels extending toward a first edge of the upper plate obliquely with respect to a longitudinal direction of the upper plate, and a plurality of upper plate inlets respectively communicating with an end of each of the first plurality of upper plate straight flow channels, each of the plurality of upper plate inlets including a first end and a second end opposite to the first end, the first end communicating with the end of a first upper plate straight flow channel of the first plurality of upper plate straight flow channels and the second end extending to the first edge of the upper plate, and wherein each of the plurality of lower plate flow channels includes:

a first plurality of lower plate straight flow channels extending toward a first edge of the lower plate obliquely with respect to a longitudinal direction of the upper plate, and a plurality of lower plate inlets respectively communicating with an end of each of the first plurality of lower plate straight flow channels, each of the plurality of lower plate inlets including a first end and a second end opposite to the first end, the first end communicating with the end of a first lower plate straight flow channel of the first plurality of lower plate straight flow channels and the second end extending to the first edge of the lower plate, and wherein the upper and lower plates are bonded to each other such that their flat surfaces face each other, such that each of the plurality of upper plate inlets coincides with each of the plurality of lower plate inlets in a stacking direction of the first and second bonding plates, and such that each of the first plurality of upper plate straight flow channels forms an overlapping section with each of the first plurality of lower plate straight flow channels, wherein the first bonding plate comprises an upper plate including a flat surface in which a plurality of upper plate flow channels are formed and a lower plate bonded to the upper plate and including a flat surface in which a plurality of lower plate flow channels are formed, each of the plurality of upper plate flow channels including an upper plate inlet, and each of the plurality of lower plate flow channels including a lower plate inlet, wherein each of the first and second bonding plates has a rectangular shape, inlets of the upper and lower plates of the first bonding plate are parallel to long sides of the first bonding plate, and inlets of the upper and lower plates of the second bonding plate are parallel to short sides of the second bonding plate.

12. The printed circuit heat exchanger according to claim 11, wherein each of the plurality of upper plate flow channels further includes:

a second plurality of upper plate straight flow channels extending toward a second edge of the upper plate obliquely with respect to a longitudinal direction of the upper plate, the second edge of the upper plate disposed opposite to the first edge of the upper plate, and a plurality of upper plate outlets respectively communicating with an end of each of the second plurality of upper plate straight flow channels, each of the plurality of upper plate outlets including a first end and a second end opposite to the first end, the first end communicating with the end of a first upper plate straight flow channel of the second plurality of upper plate straight flow channels and the second end extending to the second edge of the upper plate; and wherein each of the plurality of lower plate flow channels includes:

a second plurality of lower plate straight flow channels extending toward a second edge of the lower plate obliquely with respect to a longitudinal direction of the lower plate, the second edge of the lower plate disposed opposite to the first edge of the lower plate, and a plurality of lower plate outlets respectively communicating with an end of each of the second plurality of lower plate straight flow channels, each of the plurality of lower plate outlets including a first end and a second end opposite to the first end, the first end communicating with the end of a first lower plate straight flow channel of the second plurality of lower plate straight flow channels and the second end extending to the second edge of the lower plate.

13. The printed circuit heat exchanger according to claim 12, wherein the upper and lower plates are bonded to each other such that the at least one upper plate outlet coincides with the at least one lower plate outlet in the stacking direction and such that the plurality of upper plate straight flow channels form an overlapping section with the plurality of lower plate straight flow channels.

14. The printed circuit heat exchanger according to claim 12, wherein each of the first edge of the upper plate and the first edge of the lower plate occurs on a first long side of the rectangular shape, and each of the second edge of the upper plate and the second edge of the lower plate occurs on a second long side of the rectangular shape disposed opposite to the first long side.

* * * * *